US010351371B2

(12) United States Patent
Aoki et al.

(10) Patent No.: US 10,351,371 B2
(45) Date of Patent: Jul. 16, 2019

(54) FEEDING APPARATUS

(71) Applicant: BROTHER KOGYO KABUSHIKI KAISHA, Nagoya-shi, Aichi-ken (JP)

(72) Inventors: Hirotaka Aoki, Nagoya (JP); Kenji Samoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/978,151

(22) Filed: Dec. 22, 2015

(65) Prior Publication Data

US 2016/0185143 A1 Jun. 30, 2016

(30) Foreign Application Priority Data

Dec. 29, 2014 (JP) ..... 2014-267027
Dec. 29, 2014 (JP) ..... 2014-267028

(51) Int. Cl.
*B65H 3/06* (2006.01)
*B65H 7/04* (2006.01)

(52) U.S. Cl.
CPC ..... *B65H 3/0684* (2013.01); *B65H 3/06* (2013.01); *B65H 7/04* (2013.01); *B65H 2511/152* (2013.01); *B65H 2511/51* (2013.01); *B65H 2511/515* (2013.01); *B65H 2553/412* (2013.01);

(Continued)

(58) Field of Classification Search
CPC ..... B65H 2511/152; B65H 3/0684; B65H 2553/612
See application file for complete search history.

(56) References Cited

U.S. PATENT DOCUMENTS 7,717,415 B2 * 5/2010 Kim ..... B65H 3/0615 271/110
8,047,531 B1 * 11/2011 Liao ..... B65H 3/0684 217/110

(Continued)

FOREIGN PATENT DOCUMENTS

JP 4-85264 A 3/1992
JP 5-97278 A 4/1993

(Continued)

OTHER PUBLICATIONS

Office Action (Notice of Reasons for Rejection) issued in related Japanese Patent Application No. 2014-267027, dated May 29, 2018.

*Primary Examiner* — Howard J Sanders
(74) *Attorney, Agent, or Firm* — Merchant & Gould P.C.

(57) ABSTRACT

A feeding apparatus includes: a loading unit configured to load a plurality of sheet-like media in a stacked state; a feeding roller configured to feed the media by rotating while abutting against the media loaded on the loading unit; an arm configured to rotatably support the feeding roller and configured to be swingable about a support shaft; at least one actuator supported by the arm to be swingable about a fulcrum provided between the support shaft and a leading end of the arm, the arm being on the same side as the feeding roller with respect to the support shaft and being farthest away from the support shaft; and at least one sensor configured to output a signal which differentiates a first posture of the at least one actuator with respect to the arm, from a second posture different from the first posture.

21 Claims, 14 Drawing Sheets

(52) U.S. Cl.
CPC .... *B65H 2553/612* (2013.01); *B65H 2553/81* (2013.01)

(56) References Cited

U.S. PATENT DOCUMENTS

| | | | | |
|---|---|---|---|---|
| 2008/0001342 | A1* | 1/2008 | Matsushima | B65H 1/14 271/3.14 |
| 2009/0066006 | A1 | 3/2009 | Lee et al. | |
| 2009/0261521 | A1* | 10/2009 | Okamoto | B65H 37/04 270/37 |

FOREIGN PATENT DOCUMENTS

| | | | |
|---|---|---|---|
| JP | 5-213483 | A | 8/1993 |
| JP | 2008-207923 | A | 9/2008 |
| JP | 2008-207941 | A | 9/2008 |
| JP | 2011-73799 | A | 4/2011 |
| JP | 2014-118248 | A | 6/2014 |

* cited by examiner

FEEDING APPARATUS

CROSS REFERENCE TO RELATED APPLICATION

The present application claims priorities from Japanese Patent Application Nos. 2014-267027 and 2014-267028 filed on Dec. 29, 2014, the disclosures of which are incorporated herein by reference in its entirety.

BACKGROUND

Field of the Invention

The present teaching relates to a feeding apparatus which feeds sheet-like media.

Description of the Related Art

Japanese Patent Application Laid-open No. 2014-118248 discloses a feeding apparatus including a paper feed tray, and a feeding unit to feed sheet-like media in the paper feed tray. The feeding unit of this feeding apparatus has a feeding roller, and an arm which rotatably supports the feeding roller and is swingably supported by a casing via a shaft. With the arm swinging along with a decrease in the residual media, the feeding roller is in constant contact with the media. Thus, by the rotation of the feeding roller, the sheet-like media are fed from the paper feed tray.

Japanese Patent Application Laid-open No. 05-97278 discloses a residual amount detection device having an actuator pivotably supported by a casing, and two optical sensors. This residual amount detection device detects the residual media in a paper feed tray by letting the two optical sensors detect a state of the actuator which pivots according to the residual amount of the sheet-like media in the paper feed tray.

SUMMARY

The present inventor has found the following problem if the residual amount detection device disclosed in Japanese Patent Application Laid-open No. 05-97278 is adopted in the feeding apparatus disclosed in Japanese Patent Application Laid-open No. 2014-118248. That is, the actuator of the residual amount detection device has its pivot fulcrum arranged above the uppermost medium of the media when the paper feed tray is loaded with the maximal loadable number of the sheet-like media. Therefore, if the adopted actuator is small-sized with a short length, then the residual media become no longer detectable when the media is decreased in amount to a certain degree whereby the leading end of the actuator can no longer reach the media but has to stay away from the media. That is, such a problem will occur that the detectable range of the plurality of residual media is narrowed. On the other hand, if the detectable range of the residual media is expanded to be, for example, from zero up to the maximal loadable number of media, then a long actuator is needed. However, because the actuator pivots according to the residual amount of the media, if the actuator is long, then it is indispensable to secure a large space for the area to be occupied by the actuator and for the motion of the actuator inside the feeding apparatus. As a result, such a problem occurs that the feeding apparatus grows in size.

Accordingly, it is an object of the present teaching to provide a feeding apparatus capable of satisfying both downsizing the apparatus by downsizing the actuator and improving the usage convenience by expanding the detectable range of the media residual amount.

Further, in the residual amount detection device disclosed in Japanese Patent Application Laid-open No. 05-97278, with one actuator and two optical sensors, it is possible to detect the residual amount of the media in the paper feed tray in three stages. However, because it is configured that the two optical sensors are arranged in sequence on the pivot trajectory of a projecting unit and the two optical sensors detect the projecting portion of the one pivoting actuator, there is a comparatively long distance from the pivot fulcrum of the actuator to the interference part of the projecting portion with the optical sensors.

In the residual amount detection device disclosed in Japanese Patent Application Laid-open No. 05-97278, with respect to a direction of stacking the media loaded on the paper feed tray, the two optical sensors are arranged on the media side from pivot fulcrum of the actuator. Because a certain length is needed from the pivot fulcrum of the actuator to the interference part of the projecting portion, it is necessary to arrange the pivot fulcrum of the actuator at a position significantly away from the media, thereby upsizing the actuator per se. If the two optical sensors are supposedly arranged in positions farther from the media than the pivot fulcrum of the actuator, then the pivot fulcrum per se becomes closer to the media but, on the other hand, a certain length is needed from the pivot fulcrum to the interference part of the projecting portion. Therefore, the actuator per se remains large-sized as it is. In this manner, if the actuator is large-sized, then any feeding apparatus adopting such a residual amount detection device is also upsized with respect to the direction orthogonal to the surface of the media.

Accordingly, it is another object of the present teaching to provide a feeding apparatus capable of downsizing the feeding apparatus along the direction of stacking the media while realizing a multistage residual amount detection.

According to a first aspect of the present teaching, there is provided a feeding apparatus including: a loading unit configured to load a plurality of sheet-like media in a stacked state; a feeding roller configured to feed the media by rotating while abutting against the media loaded on the loading unit; an arm configured to rotatably support the feeding roller and configured to be swingable about a support shaft; at least one actuator supported by the arm to be swingable about a fulcrum provided between the support shaft and a leading end of the arm, the arm being on the same side as the feeding roller with respect to the support shaft and being farthest away from the support shaft; and at least one sensor configured to output a signal which differentiates a first posture of the at least one actuator with respect to the arm, from a second posture different from the first posture.

According to a second aspect of the present teaching, there is provided a feeding apparatus including: a loading unit configured to load a plurality of sheet-like media in a stacked state; a feeding roller configured to feed the media by rotating while abutting against the media loaded on the loading unit; an arm configured to rotatably support the feeding roller and configured to be swingable about a support shaft; an actuator supported by the arm to be swingable about a fulcrum provided between the support shaft and a leading end of the arm, the leading end being on the same side as the feeding roller with respect to the support shaft and being farthest from the support shaft; a sensor configured to output signals different from each other in an interference state interfering with the actuator and in a noninterference state not interfering with the actuator; and a contact member configured to be in contact with the actuator, wherein while a load amount of the media on the loading unit is decreased from a first predetermined amount to a second predetermined amount less than the first predetermined amount, the actuator is configured to swing about the fulcrum while being in contact with the media loaded on the loading unit, and to be switched at least once between a first posture and a second posture different from the first posture, under a condition that the load amount of the media on the loading unit is not less than the first predetermined amount, the actuator is configured to be in contact with the contact member and to be kept in the first posture, under a condition that the load amount of the media on the loading unit is less than the first predetermined amount, the actuator is configured to be apart from the contact member and switched to the second posture, and the sensor is configured to be in one of the interference state and the noninterference state under a condition that the actuator is in the first posture, and to be in the other of the interference state and the noninterference state under a condition that the actuator is in the second posture.

According to the feeding apparatus of the present teaching, due to the swing of the arm, the fulcrum of the actuator varies in position with the residual amount change of the media loaded on the loading unit and, moreover, the actuator per se swings about the fulcrum. Therefore, even if the used actuator is comparatively short and small-sized, it is still possible to expand the range of load amount of the media in the loading unit where the actuator is contactable with the media by following the residual amount change of the media. Thereby, it is possible to appropriately select the media residual amount from a wide load amount when the actuator switches its swing posture between the first posture and the second posture. Hence, it is possible to satisfy both downsizing the device by downsizing the actuator and improving the usage convenience by expanding the detectable range of the media residual amount.

BRIEF DESCRIPTION OF THE DRAWINGS

FIGS. 13A and 13B show a paper feed unit of a paper feed device according to another modification of the embodiment of the present teaching, wherein FIG. 13A is a schematic lateral view showing a positional relationship between the two actuators and the two sensors when the paper load amount of the paper feed tray is the predetermined amount A2, and FIG. 13B is a schematic lateral view showing a positional relationship between the two actuators and the two sensors when the paper load amount of the paper feed tray is the predetermined amount A3.

FIGS. 14A and 14B show a paper feed unit of a paper feed device according to still another modification of the embodiment of the present teaching, wherein FIG. 14A is a schematic lateral view showing a positional relationship between the two actuators and the two sensors when the paper load amount of the paper feed tray is the predetermined amount A4, and FIG. 14B is a schematic lateral view showing a positional relationship between the two actuators and the two sensors when there is no paper in the paper feed tray.

DESCRIPTION OF THE EMBODIMENT

Figure 1:
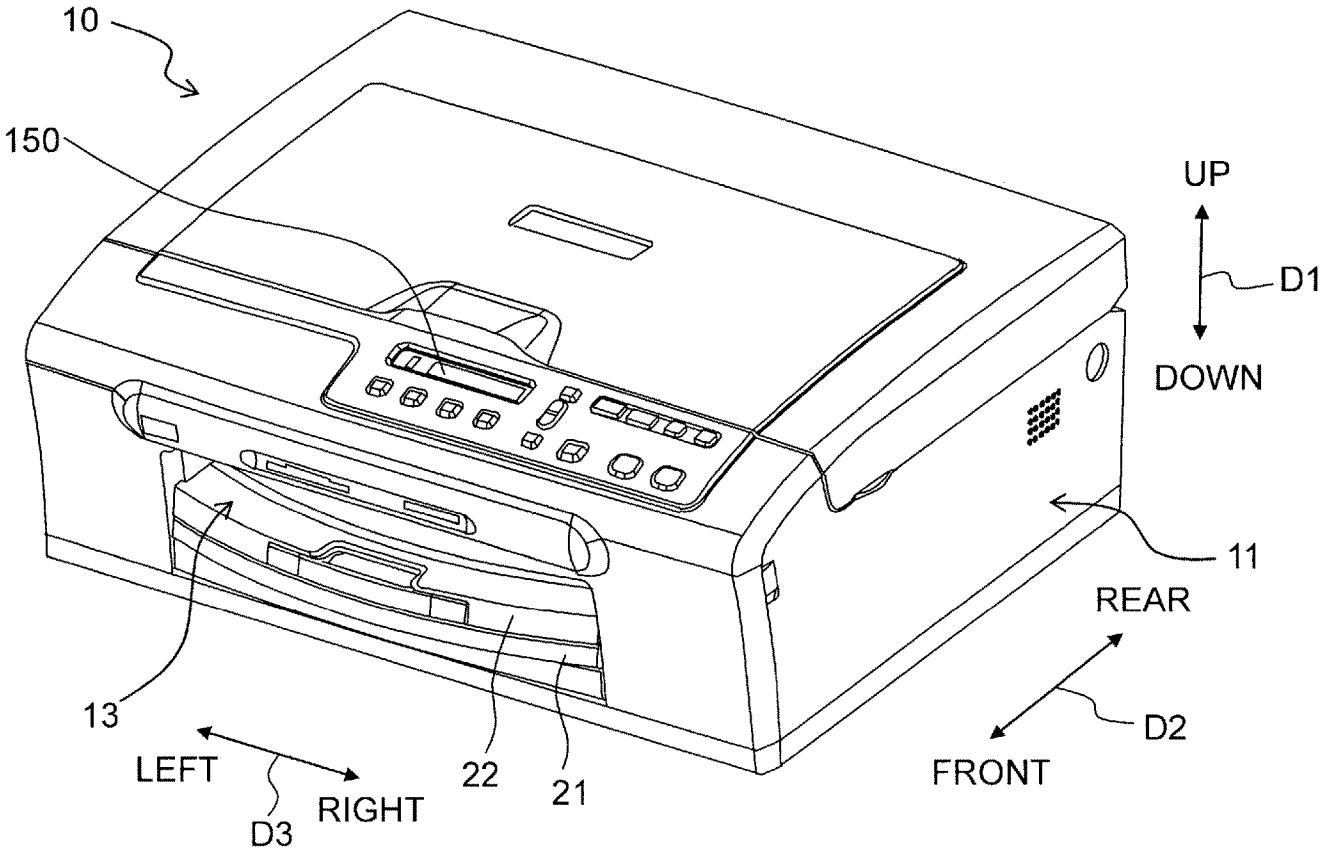
FIG. 1 is a perspective view of a multifunction printer adopting a paper feed device according to an embodiment of the present teaching.

Hereinbelow, referring to the accompanying drawings as appropriate, one preferred embodiment of the present teaching will be explained. In the following explanation, an up-down direction D1 is defined with reference to such a state (the state as shown in FIG. 1) that a multifunction printer 10 is set up to be usable and adopts a paper feed device 20 which is the one embodiment according to the present teaching; a front-rear direction D2 is defined with the side where an opening 13 is provided as the near side (the front side); and a left-right direction D3 is defined as the multifunction printer 10 is viewed from the near side (the front side). Further, while the present teaching holds independent of the number of actuators included in a feeding apparatus, the explanation will be made hereinbelow on the feeding apparatus including two actuators as one example.

<Overall Structure of Multifunction Printer 10>

As shown in FIG. 1, the multifunction printer 10 has an approximately cuboid shape, and is provided with a printer unit 11 in a lower part thereof. The multifunction printer 10 has various functions such as a facsimile function, a print function, etc. As the print function, the multifunction printer 10 has a function of recording image on a single side of a sheet of paper 12 (the sheet-like media; see FIG. 2) by an ink jet method. Further, the multifunction printer 10 may also be a device which records image on both sides of the paper 12. Further, a display 150 is provided in the upper surface of the multifunction printer 10 at the front side. The display 150 displays some states of the multifunction printer 10 (residual amount of paper and the like, for example).

Figure 2:
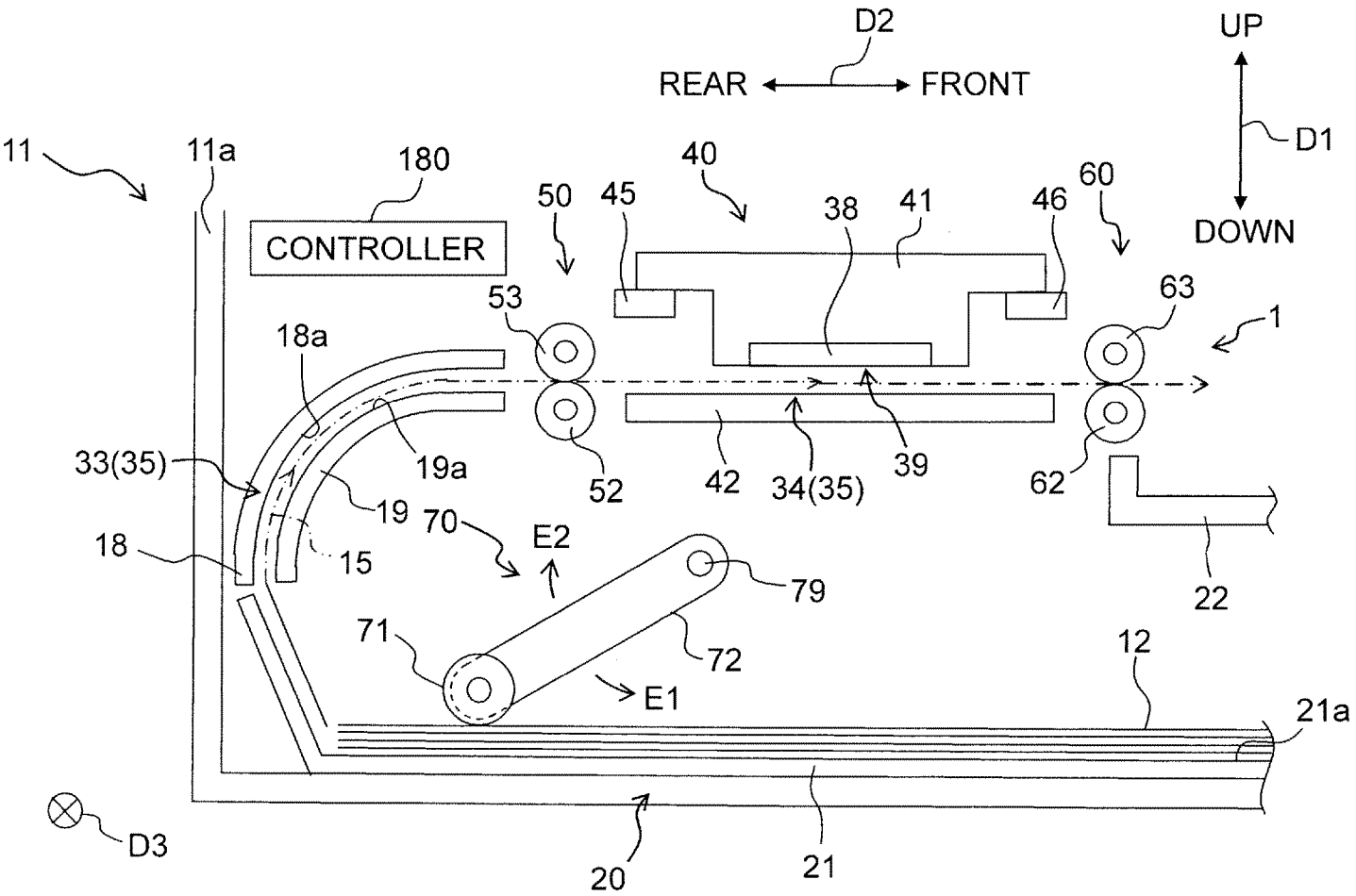
FIG. 2 is a schematic lateral view showing an internal structure of a printer unit of the multifunction printer shown in FIG. 1.

As shown in FIG. 2, the printer unit 11 has a casing 11*a*, a transport device 1 to transport the paper 12 inside the multifunction printer 10, a recording unit 40, a controller 180, and the like. The casing 11*a* is the body frame of the printer unit 11 and, as shown in FIG. 2, contains the transport device 1, the recording unit 40, and the controller 180. The transport device 1 transports the paper 12 inside the multifunction printer 10. The transport device 1 includes a paper feed device 20, a platen 42, a transport roller pair 50 and a discharge roller pair 60 all of which will be described later on.

The paper feed device 20 picks up the paper 12 from a paper feed tray 21 and feeds the same to a transport path 35. The transport roller pair 50 transports the paper 12 fed into the transport path 35 with the paper feed device 20 to the downstream side in a transport orientation 15 indicated with the arrows of a one-dot chain line shown in FIG. 2. That is, the transport roller pair 50 transports the paper 12 frontward. The platen 42 supports, from below, the paper 12 transported by the transport roller pair 50. The recording unit 40 records image by jetting ink droplets to the paper 12 supported on the platen 42. The discharge roller pair 60 frontward transports the paper 12 with the image recorded thereon by the recording unit 40 and discharges the same to a discharge tray 22.

<Paper Feed Device 20>

Subsequently, referring to FIG. 1 through FIGS. 8A and 8B, the paper feed device 20 will be explained below. As shown in FIG. 2, the paper feed device (feeding apparatus) 20 has the paper feed tray 21 and a paper feed unit 70. The paper feed unit 70 picks up the paper 12 from the paper feed tray 21 and sends the same to the transport path 35. The paper feed unit 70 in this embodiment feeds the paper 12 rearward.

As shown in FIG. 1, the opening 13 is formed in the front side of the printer unit 11. The paper feed tray (loading unit) 21 is supported by the casing 11*a* to be insertable and removable through the opening 13 in the front-rear direction D2. The paper feed tray 21 accommodates a plurality of sheets of the paper 12 by loading the plurality of sheets of the paper 12 in a stacked fashion on its bottom 21*a*. The discharge tray 22 is arranged above the paper feed tray 21. The discharge tray 22 moves integrally with the paper feed tray 21. The discharge tray 22 supports the paper 12 on which the image is recorded by the recording unit 40 and which has been discharged by the discharge roller pair 60.

<Paper Feed Unit 70>

Figure 3:
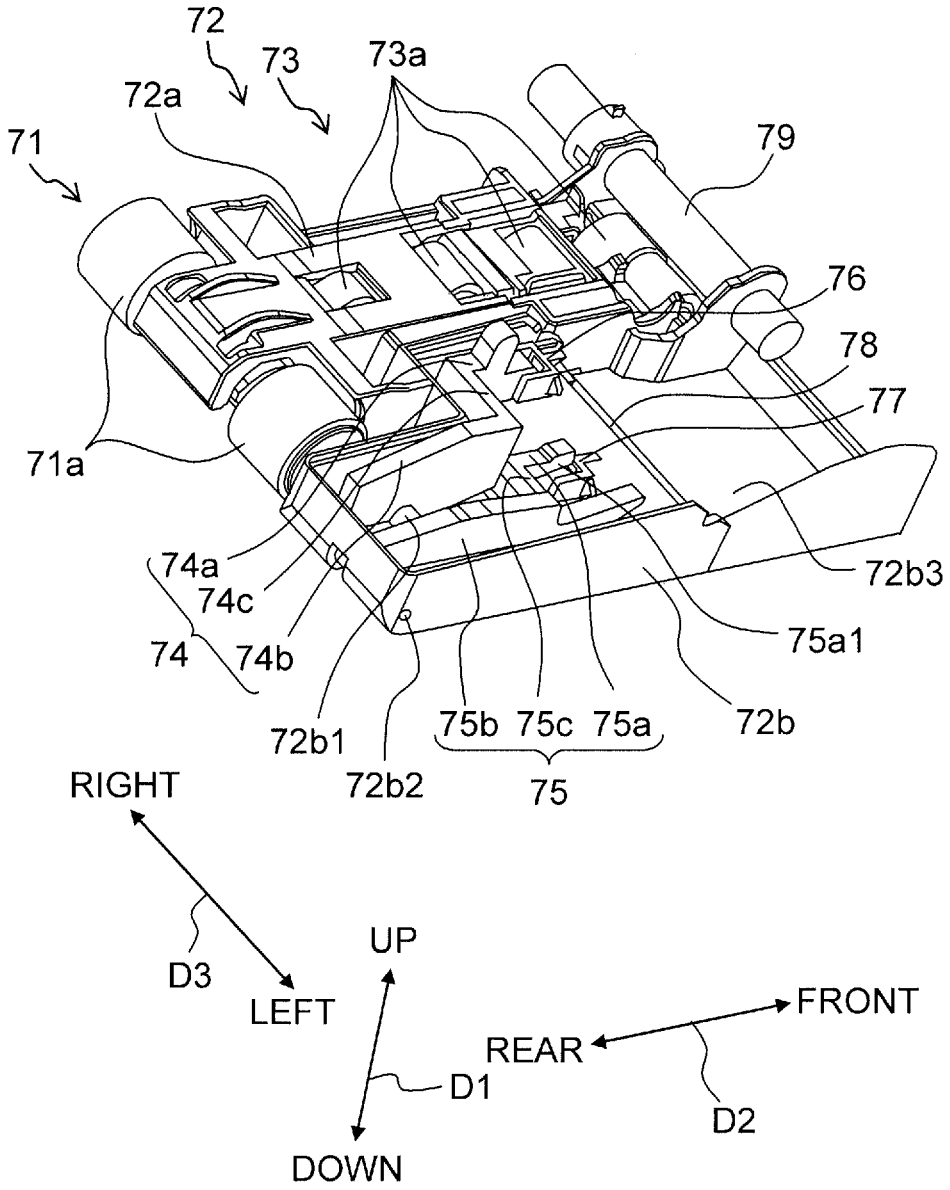
FIG. 3 is a perspective view showing a paper feed unit.

As shown in FIG. 2, the paper feed unit 70 is provided above the paper feed tray 21 and below the recording unit 40, on the upstream side from the transport path 35 in the transport orientation 15. As shown in FIGS. 2 and 3, the paper feed unit 70 has a paper feed roller 71, an arm 72, a transmission mechanism 73, two actuators 74 and 75, and two sensors 76 and 77.

As shown in FIG. 3, the arm 72 has an arm body 72*a*, and a support frame 72*b* integrated with the arm body 72*a*. As shown in FIG. 2, the arm body 72*a* is supported by the casing 11*a* to be swingable in an arrow E1 orientation (counterclockwise) and an arrow E2 orientation (clockwise) about a support shaft 79 provided in a base end portion to the front in the front-rear direction D2, as viewed from the left to the right in the left-right direction D3. By virtue of this, the arm 72 is also configured to be swingable in the arrow E1 orientation and the arrow E2 orientation with respect to the casing 11*a*. The support shaft 79 is fixed on the casing 11*a* and arranged above the paper feed tray 21 according to the up-down direction D1. The arm body 72*a* rotatably supports the paper feed roller 71 at a leading end portion positioned to the rear in the front-rear direction D2 and, by its own weight, is biased downward in the arrow E1 orientation (the counterclockwise orientation in FIG. 1). By virtue of this, with the paper feed tray 21 being installed in the casing 11*a*, the paper feed roller 71 is contactable with the paper 12 loaded on the paper feed tray 21.

Further, the arm 72 is provided with a retreat member (not shown) to temporarily raise and retreat the entire arm 72 up to almost the same height as the support shaft 79, by revolving the arm 72 through a temporary engagement with a lateral wall of the paper feed tray 21 when inserting or removing the paper feed tray 21 into or from the casing 11*a*. By virtue of this, when inserting or removing the paper feed tray 21 having accommodated the maximal load of the paper 12 into or from the casing 11*a*, the paper 12 in the paper feed tray 21 no longer interferes with the paper feed roller 71 and the two actuators 74 and 75, so that it is possible to smoothly carry out the operations of inserting and removing the paper feed tray 21.

As shown in FIG. 3, the transmission mechanism 73 has a plurality of gears 73*a* supported to be rotatable about a rotary shaft (not shown) along the left-right direction D3, inside the arm body 72*a*. Further, while only four of the gears 73*a* are shown in FIG. 3, one more gear 73*a* not shown in FIG. 3 is provided between a pair of aftermentioned rollers 71*a* inside the leading end portion of the arm body 72*a*. These plurality of gears 73*a* are arranged to engage with each other. Then, a drive force is transmitted from a paper feed motor 71M (see FIG. 9) to the gear 73*a* arranged in the base end of the arm body 72*a*, so as to rotate the plurality of gears 73*a*.

The paper feed roller (feeding roller) 71 has the pair of rollers 71*a*. The pair of rollers 71*a* are arranged across the leading end portion of the arm body 72*a* according to the left-right direction D3. Further, the pair of rollers 71*a* are fixed on the rotary shaft of the unshown gear 73*a* provided inside the leading end portion of the arm body 72*a*. The paper feed roller 71 is also rotated by the rotation of the plurality of gears 73*a* of the transmission mechanism 73 due to the drive force of the paper feed motor 71M. Because of the rotation of the paper feed roller 71, the paper 12 in the paper feed tray 21 is fed toward the transport path 35.

Figure 4A:
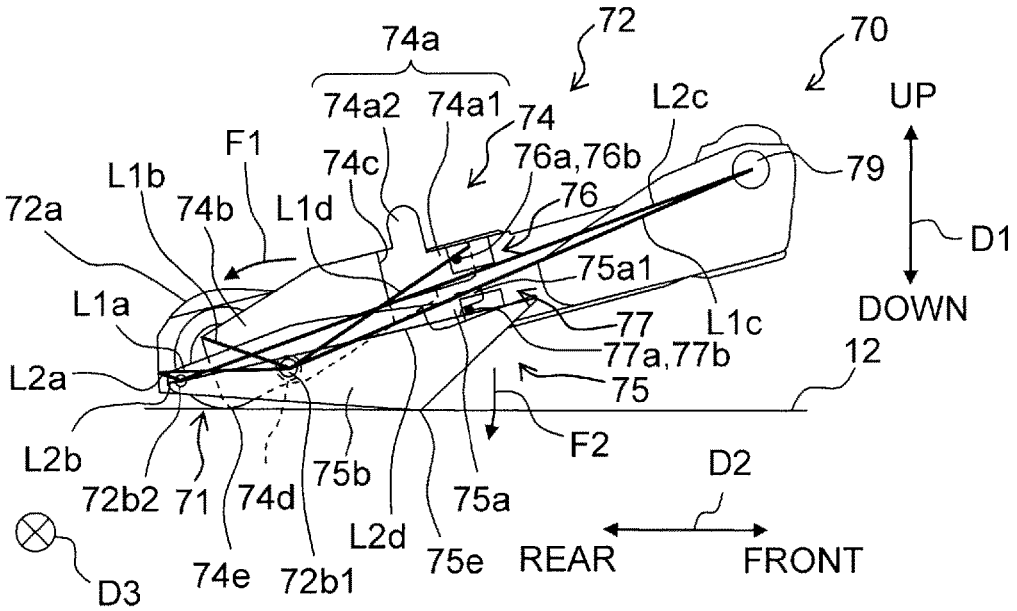
FIG. 4A is an explanatory diagram for explaining a length relationship between an arm body of the paper feed unit and two actuators.

As shown in FIG. 3, the support frame 72*b* has an approximately box-like shape, and is provided on a wall of the arm body 72*a* at the left side according to the left-right direction D3. Inside the support frame 72*b*, there are provided the two actuators 74 and 75 and the two sensors 76 and 77. That is, the support frame 72*b* serves for supporting the actuators 74 and 75 and the sensors 76 and 77. The support frame 72*b* is provided with two support shafts 72*b*1 and 72*b*2 extending in the left-right direction D3. As shown in FIG. 4A, the support shaft 72*b*1 is arranged between the support shaft 79 and the support shaft 72*b*2. More specifically, the support shaft 72*b*1 is not only arranged between the support shaft 79 and the support shaft 72*b*2 according to the up-down direction D1 but also arranged between the support shaft 79 and the support shaft 72*b*2 according to the front-rear direction D2. In other words, the support shaft 72*b*2 is more distanced from the support shaft 79 than the support shaft 72*b*1 is. Two openings (not shown) are formed in a bottom 72*b*3 of the support frame 72*b* to penetrate therethrough in the up-down direction D1. These openings face the actuators 74 and 75 in the up-down direction D1, respectively. By virtue of this, it is possible for the actuators 74 and 75 to come into and go out of the support frame 72*b* via the openings, thereby being contactable with the paper 12.

Figure 4B:
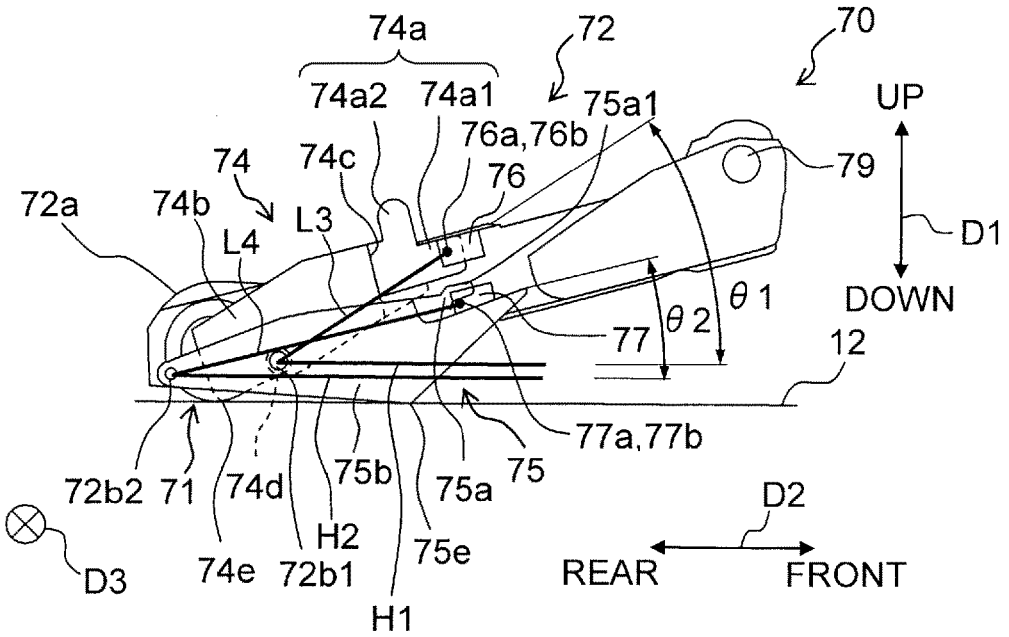
FIG. 4B is an explanatory diagram for explaining an arrangement angle for two sensors of the paper feed unit.

As shown in FIG. 3 and FIGS. 4A and 4B, the actuator 74 is supported by the support frame 72*b* to be swingable about the support shaft 72*b*1 (the fulcrum; the second fulcrum). The actuator 74 has a front portion 74*a* positioned to the front according to the front-rear direction D2, a rear portion 74*b* positioned to the rear, and a connecting portion 74*c* connecting the front portion 74*a* and the rear portion 74*b*. Both the front portion 74*a* and the rear portion 74*b* extend along a direction orthogonal to the support shaft 72*b*1. The connecting portion 74*c* extends in the left-right direction D3. The front portion 74*a* and rear portion 74*b* are arranged to deviate in position from each other in the left-right direction D3. The actuator 74 is supported by the support shaft 72*b*1 in a lower part according to the up-down direction D1 in a central part of the rear portion 74*b* according to its extending direction. Further, as shown in FIG. 4A, a coil spring 74*d* (the biasing member) is provided at the periphery of the support shaft 72*b*1. One end of the coil spring 74*d* engages with the rear portion 74*b* while the other end engages with the support frame 72*b* such that, as shown in FIG. 4A, as viewed from the left to the right in the left-right direction D3, the coil spring 74*d* biases the actuator 74 counterclockwise. That is, it biases the actuator 74 in an arrow F1 direction.

As shown in FIG. 4A, a contact part 74*e* where the actuator 74 contacts with the paper 12 loaded on the paper feed tray 21 is a lower portion of the rear portion 74*b* according to the up-down direction D1, and is positioned farther away from the support shaft 79 than the support shaft 72*b*1 in the front-rear direction D2. From this point onward, the actuator 74 is also configured to swing in the same direction as the arm 72. In particular, if the paper 12 on the paper feed tray 21 decreases, then the arm 72 swings in the arrow E1 orientation. On this occasion, the actuator 74 also swings in the same orientation (arrow F1).

The front portion 74*a* of the actuator 74 is provided with an interference portion 74*a*1 and a contact portion 74*a*2. The interference portion 74*a*1 is formed in the front portion 74*a* to the front according to the front-rear direction D2 and configured to be able to interfere with the sensor 76 as will be described later on. The contact portion 74*a*2 is formed to the rear from the interference portion 74*a*1 according to the front-rear direction D2 to project upward from the interference portion 74*a*1 in the up-down direction D1, and configured to be contactable with an aftermentioned frame 11*a*1 (the contact member) of the casing 11*a*.

As shown in FIG. 4A, the actuator 74 is configured to be shorter than the arm body 72*a*. In detail, a distance on a virtual line L1*a* is longer than another distance on a virtual line L1*b*, the distance on the virtual line L1*a* being from the support shaft 72*b*1 of the arm body 72*a* to the leading end of the arm body 72*a* (the leading end of the arm 72 distanced farthest from the support shaft 79 on the same side as the paper feed roller 71 from the support shaft 79) while the distance on the virtual line L1*b* being from the position farthest from the support shaft 79 of the actuator 74, to the support shaft 72*b*1. Further, a distance on a virtual line L1*c* from the support shaft 72*b*1 of the arm body 72*a* to the support shaft 79 is longer than another distance on a virtual line L1*d* from the position nearest to the support shaft 79 of the actuator 74, to the support shaft 72*b*1.

As shown in FIG. 3 and FIG. 4A, the actuator 75 is supported by the support frame 72*b* to be swingable about the support shaft 72*b*2 (the fulcrum; the second fulcrum). The actuator 75 has a front portion 75*a* positioned to the front in the front-rear direction D2, a rear portion 75*b* positioned to the rear, and a connecting portion 75*c* connecting the front portion 75*a* and the rear portion 75*b*. The rear portion 75*b* extends in a direction orthogonal to the support shaft 72*b*2. The connecting portion 75*c* extends in the left-right direction D3 from a fairly frontal part from the center of the rear portion 75*b* in its extending direction. The front portion 75*a* extends frontward from a right end portion of the connecting portion 75*c*. In this manner, the actuator 75 is also arranged to deviate the front portion 75*a* from the rear portion 75*b* in the left-right direction D3. The front portion 75*a* has an interference portion 75*a*1 able to interfere with the sensor 77 as will be described later on. The actuator 75 is supported by the support shaft 72*b*2 in a rear end portion of the rear portion 75*b*. By virtue of this, the actuator 75 is biased by its own weight in the arrow F2 direction, that is, clockwise in FIG. 4A.

As shown in FIG. 4A, a contact part 75*e* where the actuator 75 contacts with the paper 12 loaded on the paper feed tray 21 is a lower portion of the rear portion 75*b* at the center according to the up-down direction D1, and the support shaft 72*b*2 is positioned farther away from the support shaft 79 than the contact part 75*e* in the front-rear direction D2. From this point onward, the actuator 75 is also configured to swing in the opposite orientation from the arm 72. In particular, if the paper 12 on the paper feed tray 21 decreases, then the arm 72 swings along the arrow E1. On this occasion, the actuator 75 swings along the arrow F2.

Further, as shown in FIG. 4A, the actuator 75 is also configured to be shorter than the arm body 72*a*. That is, a distance on a virtual line L2*a* is longer than another distance on a virtual line L2*b*, the distance on the virtual line L2*a* being from the support shaft 72*b*2 of the arm body 72*a* to the leading end of the arm body 72*a* (the leading end of the arm 72 distanced farthest from the support shaft 79 on the same side as the paper feed roller 71 from the support shaft 79) while the distance on the virtual line L2*b* being from the position farthest from the support shaft 79 of the actuator 75, to the support shaft 72*b*2. Further, a distance on a virtual line L2*c* from the support shaft 72*b*2 of the arm body 72*a* to the support shaft 79 is longer than another distance on a virtual line L2*d* from the position nearest to the support shaft 79 of the actuator 75, to the support shaft 72*b*2. In this manner, the actuator 75 is configured to be shorter than the arm body 72*a*.

Further, the actuator 75 is arranged to align itself with the actuator 74 along the left-right direction D3. In other words, the two actuators 74 and 75 are arranged at almost the same position in terms of the front-rear direction D2 (the direction for the paper feed roller 71 to feed the paper 12). Therefore, it is possible to downsize the paper feed device 20 in the front-rear direction D2.

As shown in FIG. 4A, in the actuator 74, the interference portion 74*a*1 (the interference part) is positioned at the opposite side from the contact part 74*e* with respect to the support shaft 72*b*1. Further, in the actuator 75, the interference portion 75*a*1 (the interference part) is positioned at the opposite side from the support shaft 72*b*2 with respect to the contact part 75*e*. In this manner, the two actuators 74 and 75 swing in opposite directions from each other (the actuator 74 along the arrow F1 whereas the actuator 75 along the arrow F2), along with the decrease in the paper 12 loaded on the paper feed tray 21.

As shown in FIG. 3 and FIGS. 4A and 4B, although arranged to deviate a little from each other in the left-right direction D3 and in the up-down direction D1, the two sensors 76 and 77 are arranged in almost the same position in terms of the front-rear direction D2. Therefore, it is possible to arrange the two sensors 76 and 77 at the positions close to each other. Hence, they become easier to fit on one wiring substrate 78 provided on the support frame 72*b*. In this manner, by fitting the two sensors 76 and 77 on the one wiring substrate 78, it is possible to reduce the number of components as compared with providing one wiring substrate for each sensor, as well as it is possible to reduce the manufacturing cost. Further, because the two sensors 76 and 77 are supported by the support frame 72*b* supporting the actuators 74 and 75 via the wiring substrate 78, it becomes easier to align the sensor 76 with the interference portion 74*a*1 of the actuator 74, and the sensor 77 with the interference portion 75*a*1 of the actuator 75. Therefore, it becomes possible to realize a high-precision detection of the residual paper.

Figure 5:
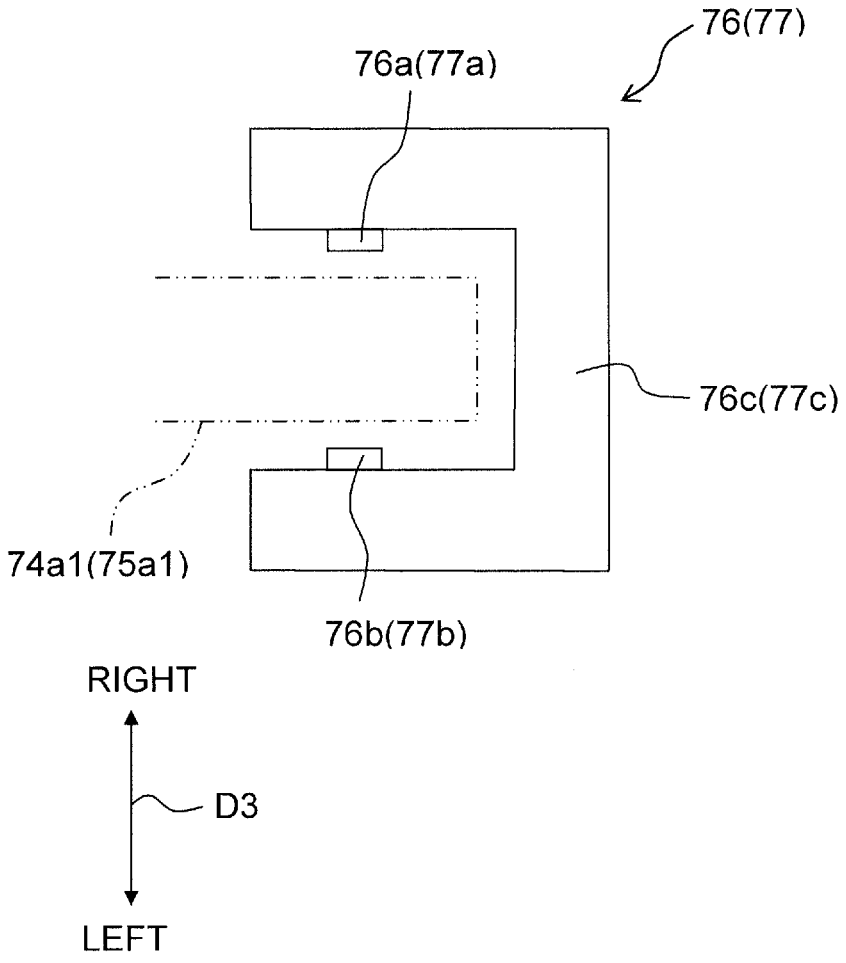
FIG. 5 is a schematic plan view of the sensor(s).

As shown in FIG. 5, the two sensors 76 and 77 are transmission-type optical sensors which have, respectively, light-emitting elements 76*a* and 77*a* such as light-emitting diodes (LED) or the like, light-receiving elements 76*b* and 77*b* such as phototransistors or the like, and casings 76*c* and 77*c*. Because the two sensors 76 and 77 have the same configuration, only the sensor 76 will be explained.

Both of the light-emitting element 76*a* and the light-receiving element 76*b* are enclosed by the casing 76*c*. As shown in FIG. 5, the casing 76*c* has a planar U-shape. The light-emitting element 76*a* is provided on the right wall of the casing 76*c* and arranged to be able to radiate light to the left side. The light-receiving element 76*b* is provided on the left wall of the casing 76*c* and arranged to be able to receive the light radiated from the light-emitting element 76*a*. In this manner, the light-emitting element 76*a* and the light-receiving element 76*b* are arranged on the U-shape casing 76*c* to face each other at a predetermined interval in the left-right direction D3. It is possible for the interference portion 74*a*1 of the actuator 74 to enter the space (the optical path of the sensor 76) between the light-emitting element 76*a* and the light-receiving element 76*b* of the sensor 76. If the interference portion 74*a*1 enters the optical path of the sensor 76 to block the light from the light-emitting element 76*a* to the light-receiving element 76*b* (that is, if the sensor 76 interferes with the actuator 74), then the sensor 76 is turned into an "ON state", and the sensor 76 outputs a signal indicating the ON state to the controller 180. On the other hand, if the interference portion 74*a*1 retreats from the optical path of the sensor 76 such that the light-receiving element 76*b* receives the light from the light-emitting element 76*a*, then the sensor 76 is turned into an "OFF state", and the sensor 76 outputs a signal indicating the OFF state to the controller 180.

Further, similar to the sensor 76, the sensor 77 has a light-emitting element 77*a* and a light-receiving element 77*b*. The light-emitting element 77*a* and the light-receiving element 77*b* are also arranged on the U-shape casing 76*c* to face each other at a predetermined interval in the left-right direction D3. It is possible for the interference portion 75*a*1 of the actuator 75 to enter the space (the optical path of the sensor 77) between the light-emitting element 77*a* and the light-receiving element 77*b* of the sensor 77. If the interference portion 75*a*1 enters the optical path of the sensor 77 to block the light from the light-emitting element 77*a* to the light-receiving element 77*b* (that is, if the sensor 77 interferes with the actuator 75), then the sensor 77 is turned into the "ON state", and the sensor 77 outputs a signal indicating the ON state to the controller 180. On the other hand, if the interference portion 75*a*1 retreats from the optical path of the sensor 77 such that the light-receiving element 77*b* receives the light from the light-emitting element 77*a*, then the sensor 77 is turned into the "OFF state", and the sensor 77 outputs a signal indicating the OFF state to the controller 180.

In this manner, the sensor 76 is in the "ON state" when the actuator 74 interferes with the sensor 76, and is in the "OFF state" when the actuator 74 does not interfere with the sensor 76, while the sensor 77 is in the "ON state" when the actuator 75 interferes with the sensor 77, and is in the "OFF state" when the actuator 75 does not interfere with the sensor 77. Further, the sensors 76 and 77 output the different signals for being interfered with and not interfered with by the actuators 74 and 75.

As shown in FIG. 4B, the two sensors 76 and 77 and the two support shafts 72*b*1 and 72*b*2 are arranged at an angle θ1 and an angle θ2 different from each other (the angle θ1>the angle θ2), respectively. The angle θ1 is formed between a virtual line segment L3 passing through the light-emitting element 76*a* (or the light-receiving element 76*b*) of the sensor 76, and a virtual horizontal plane H1 passing through the support shaft 72*b*1 (a plane parallel to the surface of the paper 12 loaded on the paper feed tray 21). The angle θ2 is formed between a virtual line segment L4 passing through the light-emitting element 77*a* (or the light-receiving element 77*b*) of the sensor 77, and a virtual horizontal plane H2 passing through the support shaft 72*b*2. By virtue of this, it is possible to easily realize a configuration of mutually different loads of the paper 12 for switching the state of the sensor 76 and switching the state of the sensor 77.

As shown in FIG. 4B, the two support shafts 72*b*1 and 72*b*2 supporting the actuators 74 and 75 are arranged to deviate from each other in the up-down direction D1 (a direction orthogonal to the surface of the paper 12 loaded on the paper feed tray 21). By virtue of this, it is possible to easily realize a configuration of mutually different loads of the paper 12 for switching between the ON state and the OFF state of the sensor 76 and switching between the ON state and the OFF state of the sensor 77.

Hereinbelow, referring to FIGS. 6A and 6B to FIG. 9, an explanation will be made on switching the states of the two sensors 76 and 77 along with the operations of the two actuators 74 and 75.

Figure 6A:
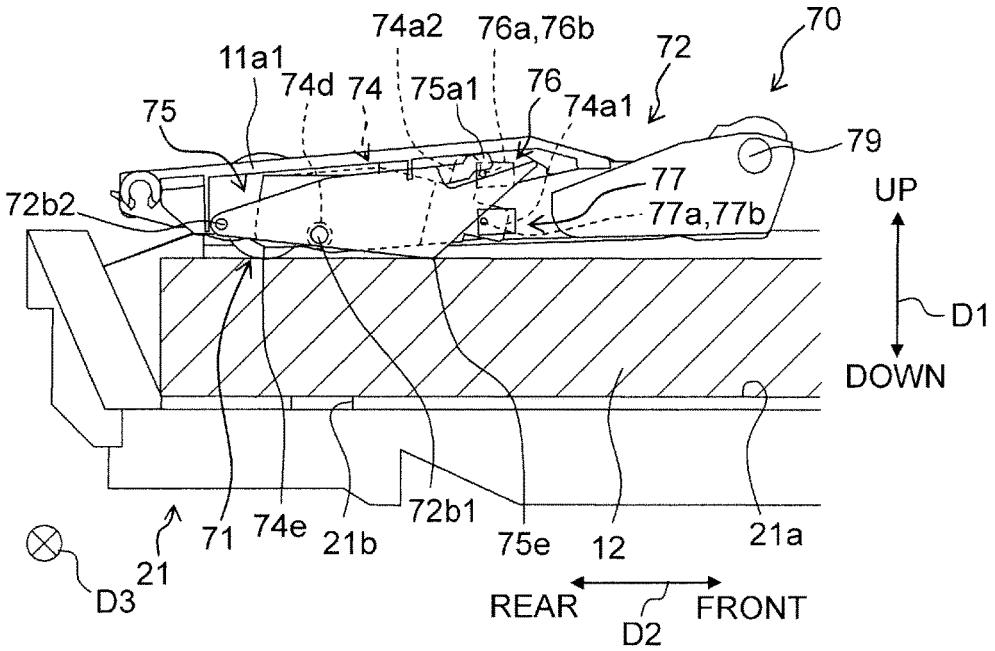
FIG. 6A is a schematic view showing a positional relationship between the two actuators and the two sensors when a paper load amount of a paper feed tray is a predetermined amount A1.

It is possible for the paper feed tray 21 according to this embodiment to be loaded with, for example, 250 sheets of A4-size plain paper at the maximum. The arm 72 swings counterclockwise in the figures once at the feeding of one sheet of paper along with the decrease in the residual paper 12 such that the paper feed roller 71 may be arranged in the position contacting with the uppermost sheet of the paper 12. As shown in FIG. 6A, if a predetermined amount A1 of the paper 12 equivalent to 250 sheets is loaded on the paper feed tray 21, then the contact portion 74*a*2 of the actuator 74 contacts with frame 11*a*1 supporting an inner guide member 19 such that the actuator 74 is maintained with the contact part 74*e* separated from the paper 12. Further, on this occasion, the interference portion 74*a*1 of the actuator 74 is in a state of having retreated downward from the optical path of the sensor 76. That is, being not interfered with by the actuator 74, the sensor 76 is in the "OFF state (the first noninterference state)". On the other hand, if the paper load amount is the predetermined amount A1 (the third predetermined amount for the actuator 75), then the actuator 75 does not contact with the frame 11*a*1 but, because of being biased by its own weight clockwise in the figure (in the arrow F2 direction in FIG. 4A), the contact part 75*e* contacts with the uppermost sheet of the paper 12. On this occasion, the interference portion 75*a*1 of the actuator 75 is in a state of having retreated upward from the optical path of the sensor 77. That is, being not interfered with by the actuator 75, the sensor 77 is in the "OFF state (the second noninterference state)".

The actuator 74 is displaced as a whole by a displacement of the support shaft 72*b*1 along with the swing of the arm 72. The contact portion 74*a*2 of the actuator 74 contacts with the frame 11*a*1 as the paper load amount of the paper feed tray 21 is between the predetermined amount A1 (see FIG. 6A) and a predetermined amount A2 (the first predetermined amount for the actuator 74; see FIG. 6B) equivalent to a first predetermined number of sheets (150 sheets for example). Therefore, the actuator 74 swings counterclockwise in the figure (in the arrow F1 direction in FIG. 4A) while being restrained from free swing. Then, if the paper load amount of the paper feed tray 21 reaches the predetermined amount A2, then the contact part 74*e* comes to contact with the paper 12. When the paper load amount of the paper feed tray 21 is the predetermined amount A2, the actuator 74 stays as it is in the state that the interference portion 74*a*1 has retreated downward from the optical path of the sensor 76. That is, the sensor 76 is kept in the "OFF state". In this manner, if the paper load amount of the paper feed tray 21 is not more than the predetermined amount A1 and not less than the predetermined amount A2, then it is possible for the actuator 74 to let the contact portion 74*a*2 contact with the frame 11*a*1 so as to reliably keep the sensor 76 in the "OFF state". On the other hand, with the contact part 75*e* in contact with the paper 12, the actuator 75 swings clockwise in the figure, that is, in the opposite direction from the arm 72 while being displaced downward as a whole by the displacement of the support shaft 72*b*2 along with the swing of the arm 72. When the paper load amount of the paper feed tray 21 reaches the predetermined amount A2, then the actuator 75 stays as it is in the state that the interference portion 75*a*1 has retreated upward from the optical path of the sensor 77. That is, the sensor 77 is kept in the "OFF state". In this manner, the actuators 74 and 75 are configured to respectively assume swing postures such that the corresponding sensors 76 and 77 may be in the "OFF state" (to be referred to below as "first postures B1 and C1) with respect to the arm 72, if the paper load amount of the paper feed tray 21 is not less than the predetermined amount A2.

Figure 6B:
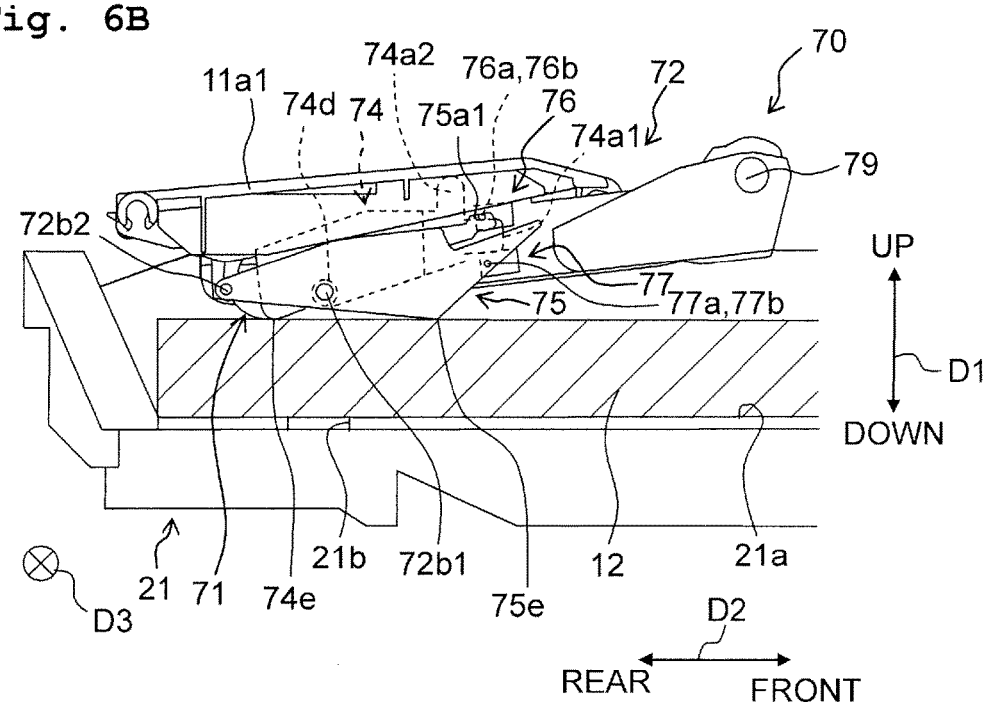
FIG. 6B is a schematic lateral view showing the positional relationship between the two actuators and the two sensors when the paper load amount of the paper feed tray is a predetermined amount A2.
Figure 7A:
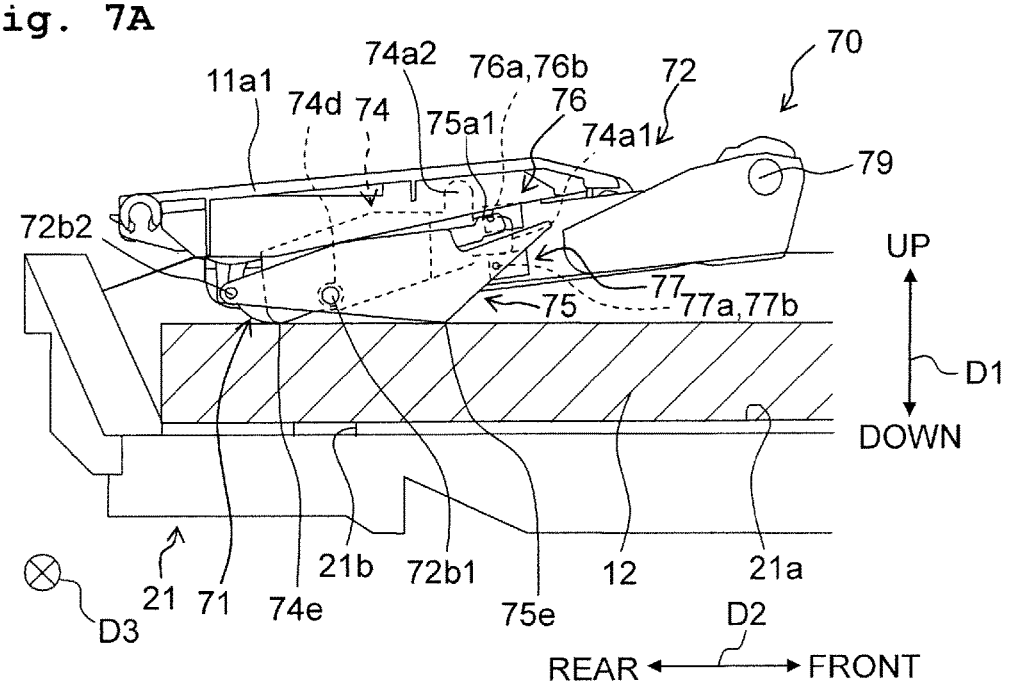
FIG. 7A is a schematic view showing the positional relationship between the two actuators and the two sensors when the paper load amount of the paper feed tray is decreased by one sheet of paper from the predetermined amount A2.

Subsequently, if the residual paper 12 further decreases, then the actuator 74 is further displaced downward as a whole by the displacement of the support shaft 72*b*1 along with the swing of the arm 72. As shown in FIG. 7A, if the paper load amount of the paper feed tray 21 is less than the predetermined amount A2, that is, if one sheet of the paper 12 is subtracted from the predetermined amount A2, then the contact portion 74*a*2 of the actuator 74 is separated from the frame 11*a*1. Therefore, if the paper load amount of the paper feed tray 21 is less than the predetermined amount A2, then the actuator 74 is released from the restraint by the contact portion 74*a*2 so as to swing counterclockwise in the figure. With the paper load amount of the paper feed tray 21 where one sheet of the paper 12 is subtracted from the predetermined amount A2, the actuator 74 is in a state that the interference portion 74*a*1 has entered the optical path of the sensor 76. That is, being interfered with by the actuator 74, the sensor 76 is switched into the "ON state" (the first interference state). Then, during the paper load amount of the paper feed tray 21 decreasing to a predetermined amount A3 (see FIG. 7B) equivalent to a second predetermined number of sheets (50 sheets for example), the actuator 74 stays as it is in the state that the interference portion 74*a*1 has entered the optical path of the sensor 76. That is, the sensor 76 is kept in the "ON state". On the other hand, the actuator 75 swings clockwise in the figure while being displaced downward as a whole by the displacement of the support shaft 72*b*2 along with the swing of the arm 72. During the paper load amount of the paper feed tray 21 decreasing from the predetermined amount A2 (see FIG. 6B) to the predetermined amount A3 (see FIG. 7B), the actuator 75 stays as it is in the state that the interference portion 75*a*1 has retreated upward from the optical path of the sensor 77. That is, being not interfered with by the actuator 75, the sensor 77 is kept in the "OFF state". In this manner, the actuator 74 is configured to assume a swing posture with respect to the arm 72 such that the sensor 76 may be turned into the "ON state" (to be referred to below as "second posture B2"), if the paper load amount of the paper feed tray 21 is less than the predetermined amount A2 but not less than the predetermined amount A3. On the other hand, on this occasion, the actuator 75 stays as it is in the first posture C1 where the sensor 77 is in the "OFF state", in the same manner as when the paper load amount of the paper feed tray 21 is not less than the predetermined amount A2.

Then, if the residual paper 12 further decreases, then the actuator 74 swings counterclockwise in the figure while being further displaced downward as a whole by the displacement of the support shaft 72*b*1 along with the swing of the arm 72. During the paper load amount of the paper feed tray 21 decreasing from the predetermined amount A3 (see FIG. 7B) to a predetermined amount A4 (a second predetermined amount for the actuator 74; see FIG. 8B) equivalent to one sheet of the residual paper, the actuator 74 stays as it is in the state that the interference portion 74*a*1 has entered the optical path of the sensor 76. That is, being interfered with by the actuator 74, the sensor 76 is kept in the "ON state". On the other hand, the actuator 75 further swings clockwise in the figure along with the decrease of the paper 12. With the paper load amount of the paper feed tray 21 shown in FIG. 7B where one sheet of the paper 12 is subtracted from the predetermined amount A3 (see FIG. 8A), the actuator 75 is in a state that the interference portion 75*a*1 has entered the optical path of the sensor 77. That is, being interfered with by the actuator 75, the sensor 77 is switched into the "ON state" (the second interference state). Then, during the paper load amount of the paper feed tray 21 decreasing to the predetermined amount A4 (the fourth predetermined amount for the actuator 75; see FIG. 8B), the actuator 75 stays as it is in the state that the interference portion 75*a*1 has entered the optical path of the sensor 77. That is, being interfered with by the actuator 75, the sensor 77 is kept in the "ON state". In this manner, if the paper load amount of the paper feed tray 21 is less than the predetermined amount A3 but not less than the predetermined amount A4, then in the same manner as when the paper load amount of the paper feed tray 21 is less than the predetermined amount A2 but not less than the predetermined amount A3, the actuator 74 stays as it is in the second posture B2 where the sensor 76 is in the "ON state". On the other hand, the actuator 75 is configured to assume a swing posture (to be referred below as "second posture C2") where the sensor 77 is in the "ON state", with respect to the arm 72.

Figure 9:
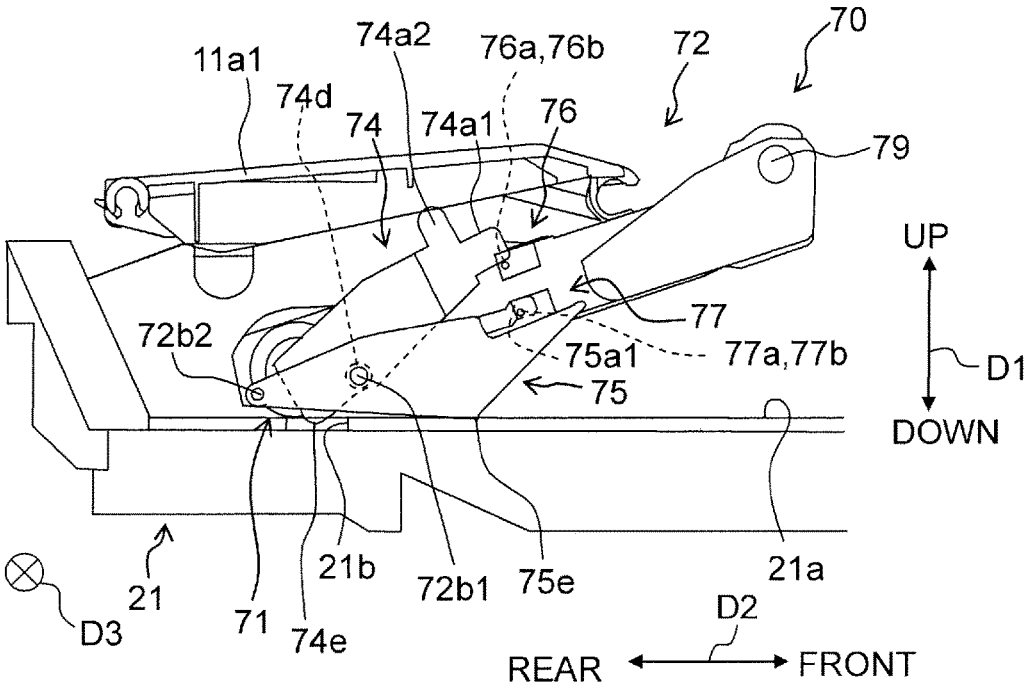
FIG. 9 is a schematic lateral view showing the positional relationship between the two actuators and the two sensors when there is no paper in the paper feed tray.

If the paper 12 of the paper feed tray 21 is used up, then as shown in FIG. 9, the arm 72 further swings counterclockwise in the figure, and thereby the paper feed roller 71 comes to contact with the bottom 21*a* of the paper feed tray 21. The actuator 74 further swings counterclockwise in the figure while being displaced downward as a whole such that contact part 74*e* falls into a hole 21*b* formed in the bottom 21*a*. On this occasion, the actuator 74 is in the state that the interference portion 74*a*1 has retreated upward from the optical path of the sensor 76. That is, being interfered with by the actuator 74, the sensor 76 is switched into the "OFF state". On the other hand, the actuator 75 further swings clockwise in the figure while being displaced downward as a whole such that the contact part 75*e* comes to contact with the bottom 21*a*. On this occasion, the actuator 75 stays as it is in the state that the interference portion 75*a*1 has entered the optical path of the sensor 77. That is, being interfered with by the actuator 75, the sensor 77 is kept in the "ON state". In this manner, the actuator 74 is configured to assume a swing posture where the sensor 76 is in the "OFF state" (to be referred to below as "third posture B3"), with respect to the arm 72, if there is no paper 12 in the paper feed tray 21. As described above, the interference portion 74*a*1 is in opposite position with respect to the sensor 76 between the first posture B1 and the third posture B3. On the other hand, the actuator 75 at this time stays as it is in the second posture C2 where the sensor 77 is in the "ON state", in the same manner as when the paper load amount of the paper feed tray 21 is less than the predetermined amount A3 but not less than the predetermined amount A4. If the paper 12 of the paper feed tray 21 decreases from one sheet to zero sheets, then the actuator 74 switches its swing posture from the second posture B2 to the third posture B3, while the sensor 76 alone switches from the "ON state" to the "OFF state". Therefore, it is possible to reliably detect the state that the paper 12 in the paper feed tray 21 is zero.

Further, the first postures B1 and C1 in this embodiment correspond to the "first posture" of the present teaching. Further, the second postures B2 and C2 in this embodiment correspond to the "second posture" of the present teaching.

In this manner, according to this embodiment, during the paper load amount of the paper feed tray 21 changing from the predetermined amount A2 (the first predetermined amount) to the predetermined amount A4 (the second predetermined amount), the actuator 74 swings counterclockwise while in contact with the paper 12 loaded on the paper feed tray 21. Then, during that period, if the paper load amount decreases by one sheet from the predetermined amount A2, then the state of the sensor 76 corresponding to the actuator 74 is switched between interference and non-interference. That is, the actuator 74 is configured, according to the present teaching, to switch between the first posture B1 and the second posture B2 during the medium load amount of the loading portion changing from the first predetermined amount to the second predetermined amount. On the other hand, during the paper load amount of the paper feed tray 21 changing from the predetermined amount A1 (the third predetermined amount) to the predetermined amount A4 (the fourth predetermined amount), the actuator 75 swings clockwise while in contact with the paper 12 loaded on the paper feed tray 21. Then, during that period, if the paper load amount decreases by one sheet from the predetermined amount A3, then the state of the sensor 77 corresponding to the actuator 75 is switched between interference and noninterference. That is, the actuator 75 is also configured, according to the present teaching, to switch between the first posture C1 and the second posture C2 during the medium load amount of the loading portion changing from the third predetermined amount to the fourth predetermined amount.

<Transport Path 35>

As shown in FIG. 2, the transport path 35 extends from a rear end portion of the paper feed tray 21. The transport path 35 includes a curved transport path 33 and a linear transport path 34. The curved transport path 33 extends to be curved with the rear side of the printer unit 11 as its curved outer side and with the front side as its curved inner side. The linear transport path 34 extends in the front-rear direction D2. The paper 12 supported on the paper feed tray 21 is transported frontward through the linear transport path 34 and then guided to the recording unit 40 after being transported through the curved transport path 33 upward to make a U-turn. The paper 12 on which image has been recorded by the recording unit 40 is further transported frontward and then discharged to the discharge tray 22.

The curved transport path 33 is formed by an outer guide member 18 and an inner guide member 19 which face each other at a predetermined interval. The casing 11*a* supports the outer guide member 18 and the inner guide member 19. Further, the inner guide member 19 is fixed on the frame 11*a*1 arranged below the transport roller pair 50. The outer guide member 18 has a guide surface 18*a* forming the curved outer side of the curved transport path 33. The inner guide member 19 has a guide surface 19*a* forming the curved inner side of the curved transport path 33. The linear transport path 34 is formed by the recording unit 40 and the platen 42 which face each other at a predetermined interval.

<Transport Roller Pair 50>

As shown in FIG. 2, the transport roller pair 50 is constructed from a pair of rollers 52 and 53, and arranged on the upstream side from the recording unit 40 in the transport orientation 15. The roller 52 is arranged below the roller 53 to contact with the lower side of the paper 12 guided from the curved transport path 33 to the linear transport path 34. The roller 52 is a driving roller to which a drive force is imparted from a transport motor 50M (see FIG. 10) to rotate the same. The roller 53 is arranged to face the roller 52 to contact with the upper side of the paper 12. The roller 53 rotates along with the rotation of the roller 52. The roller 52 and the roller 53 cooperate to nip the paper 12 along the up-down direction D1 to transport the same in the transport orientation 15.

<Discharge Roller Pair 60>

As shown in FIG. 2, the discharge roller pair 60 is constructed from a pair of rollers 62 and 63, and arranged on the downstream side from the recording unit 40 in the transport orientation 15. The roller 62 is arranged below the roller 63 to contact with the lower side of the paper 12 transported through the linear transport path 34. The roller 62 is a driving roller to which the drive force is imparted from the transport motor 50M to rotate the same. The roller 63 is arranged to face the roller 62 to contact with the upper side of the paper 12. The roller 63 is a spur roller rotating along with the rotation of the roller 62. The roller 62 and the roller 63 cooperate to nip the paper 12 along the up-down direction D1 to transport the same in the transport orientation 15. As a result, the paper 12 is transported by the discharge roller pair 60 toward the opening 13 positioned on the downstream side in the transport orientation 15 and then discharged to the discharge tray 22.

<Platen 42>

As shown in FIG. 2, the platen 42 is provided below the linear transport path 34 and between the transport roller pair 50 and the discharge roller pair 60. The platen 42 is a plate-like member arranged to face the recording unit 40 in the up-down direction D1 to support, from below, the paper 12 transported through the linear transport path 34.

<Recording Unit 40>

As shown in FIG. 2, the recording unit 40 is arranged in a position above the linear transport path 34 to face the platen 42 in the up-down direction D1. The recording unit 40 has a carriage 41, a recording head 38, and a drive mechanism 40*a* (see FIG. 10). The carriage 41 is supported by two guide rails 45 and 46. The two guide rails 45 and 46 are arranged apart from each other in the front-rear direction D2 to extend respectively in the left-right direction D3. The carriage 41 is arranged to ride across on the two guide rails 45 and 46. Further, the drive mechanism 40*a* has a carriage drive motor 40M and, by the control of the controller 180, reciprocatingly moves the carriage 41 along the two guide rails 45 and 46 in the left-right direction D3 which is a main scanning direction. The recording head 38 is mounted on the carriage 41. The recording head 38 jets ink supplied from an ink cartridge (not shown) from nozzles 39 provided in its lower surface. That is, in the course of the carriage 41 moving in the left-right direction D3, image is recorded on the upper side of the paper 12 supported on the platen 42 by jetting ink droplets from the nozzles 39 of the recording head 38 toward the platen 42.

<Controller 180>

Figure 10:
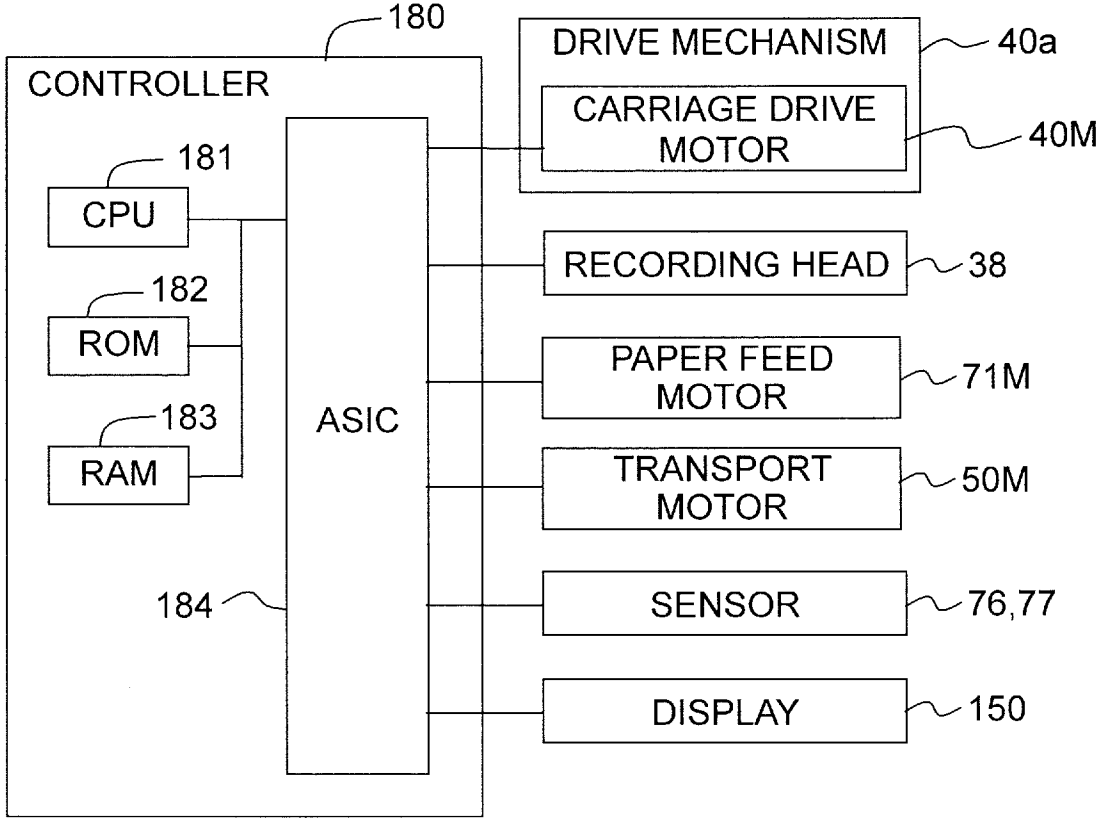
FIG. 10 is a block diagram of a controller.

As shown in FIG. 10, the controller 180 includes a CPU (Central Processing Unit) 181, a ROM (Read Only Memory) 182, a RAM (Random Access Memory) 183, an ASIC (Application Specific Integrated Circuit) 184, etc. These components cooperate to control the operations of the carriage drive motor 40M, the recording head 38, the paper feed motor 71M, the transport motor 50M, the display 150, and the like. For example, based on a record command sent from an external device such as a PC or the like, the controller 180 controls the recording head 38, carriage drive motor 40M, paper feed motor 71M, transport motor 50M and the like to record image and the like on the paper 12.

Figure 11:
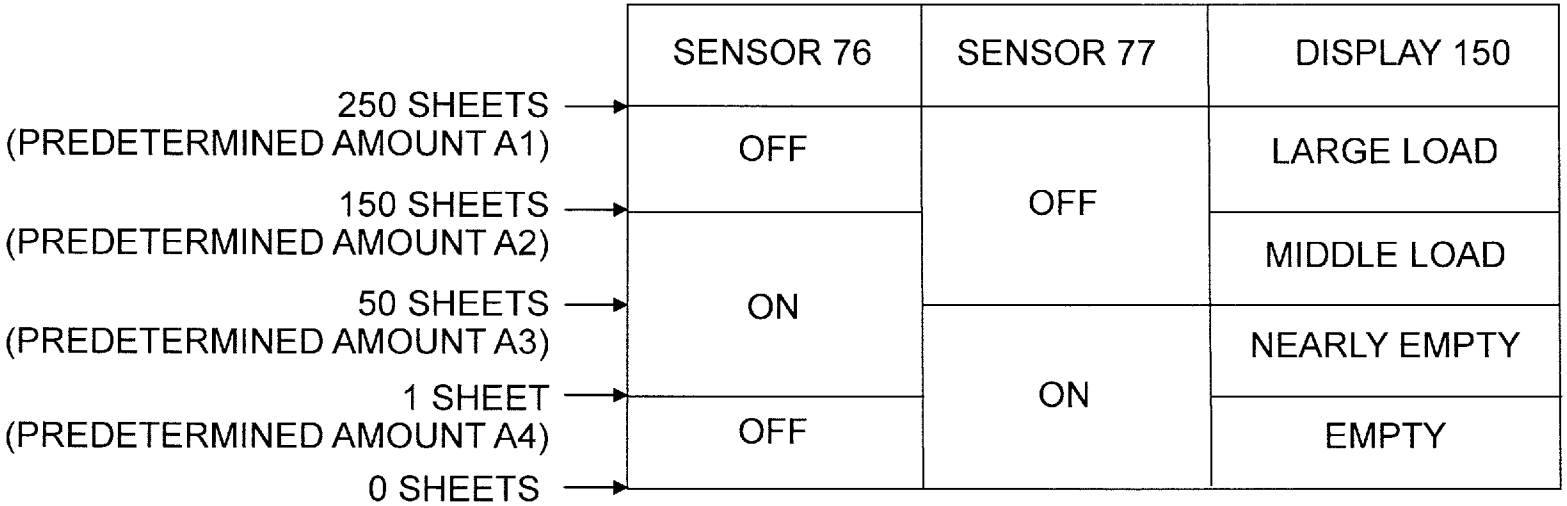
FIG. 11 is an explanatory diagram showing residual amount of papers corresponding to states of the two sensors.

Further, the ROM 182 stores the combination of four types of states of the two sensors 76 and 77. The combination of four types corresponds to the residual paper state in four stages. In particular, as shown in FIG. 11, when the sensor 76 is in the OFF state while the sensor 77 is in the ON state, the combination corresponds to no paper or being empty of paper; when the sensor 76 is in the ON state and the sensor 77 is also in the ON state, it corresponds to a nearly empty state; when the sensor 76 is in the ON state while the sensor 77 is in the OFF state, it corresponds to a moderate load of paper; and when the sensor 76 is in the OFF state and the sensor 77 is also in the OFF state, it corresponds to a large load of paper. Then, based on the signals from the sensors 76 and 77, the controller 180 causes the display 150 to display the residual amount of paper.

Further, although one CPU 181 and one ASIC 184 are shown in FIG. 10, the controller 180 may include either only one CPU 181 to let this one CPU 181 collectively perform necessary processes or a plurality of CPUs 181 to let these plurality of CPUs 181 share the performance of necessary processes. Further, the controller 180 may include either only one ASIC 184 to let this one ASIC 184 collectively perform necessary processes or a plurality of ASICs 184 to let these plurality of ASICs 184 share the performance of necessary processes.

Subsequently, detection of the residual amount of paper will be explained below. As shown in FIGS. 6A and 6B, if the paper load amount of the paper feed tray 21 is not less than the predetermined amount A2, because the contact portion 74*a*2 of the actuator 74 is in contact with the frame 11*a*1, the actuator 74 is in the noninterference state. On this occasion, the actuator 75 is also in the noninterference state. Both of the two sensors 76 and 77 are in the OFF state, and respectively output the signals indicating the OFF state to the controller 180. By virtue of this, based on the signals from the two sensors 76 and 77, the controller 180 determines it as the state of large load indicating that the residual paper 12 of the paper feed tray 21 is sufficient. Then, the controller 180 causes the display 150 to display that the paper load amount is large.

While the display 150 is caused to display the residual state of the paper 12 in this embodiment, an external device (a PC for example) may instead be caused to display the residual state of the paper 12.

Figure 7B:
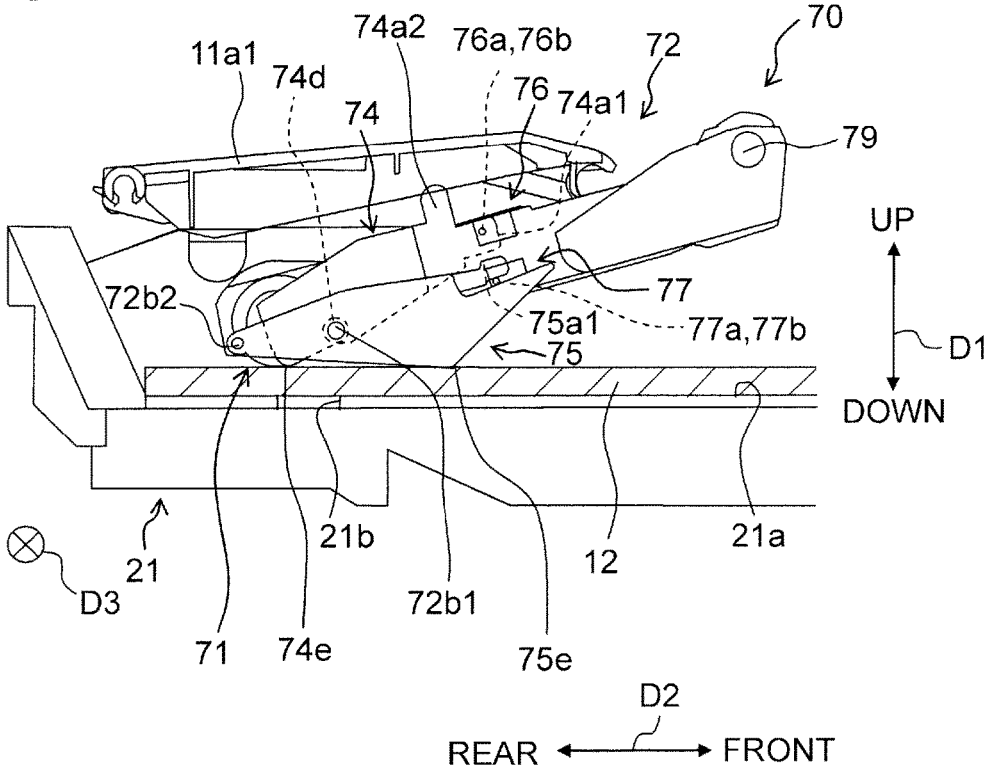
FIG. 7B is a schematic view showing the positional relationship between the two actuators and the two sensors when the paper load amount of the paper feed tray is a predetermined amount A3.

Next, along with the recording and the like carried out on the paper 12, the paper 12 decreases and, as shown in FIGS. 7A and 7B, if the paper load amount of the paper feed tray 21 is less than the predetermined amount A2 but not less than the predetermined amount A3, then the actuator 74 falls into the interference state from the noninterference state, while the actuator 75 stays continuously in the noninterference state. On this occasion, the sensor 76 falls into the ON state and outputs the signal indicating the ON state to the controller 180, while the sensor 77 successively outputs the signal indicating the OFF state to the controller 180. By virtue of this, based on the signals from the two sensors 76 and 77, the controller 180 determines it as the moderate load of paper indicating that the residual paper 12 of the paper feed tray 21 has decreased to some extent. Then, the controller 180 causes the display 150 to display that the load amount of the paper 12 is moderate.

Figure 8A:
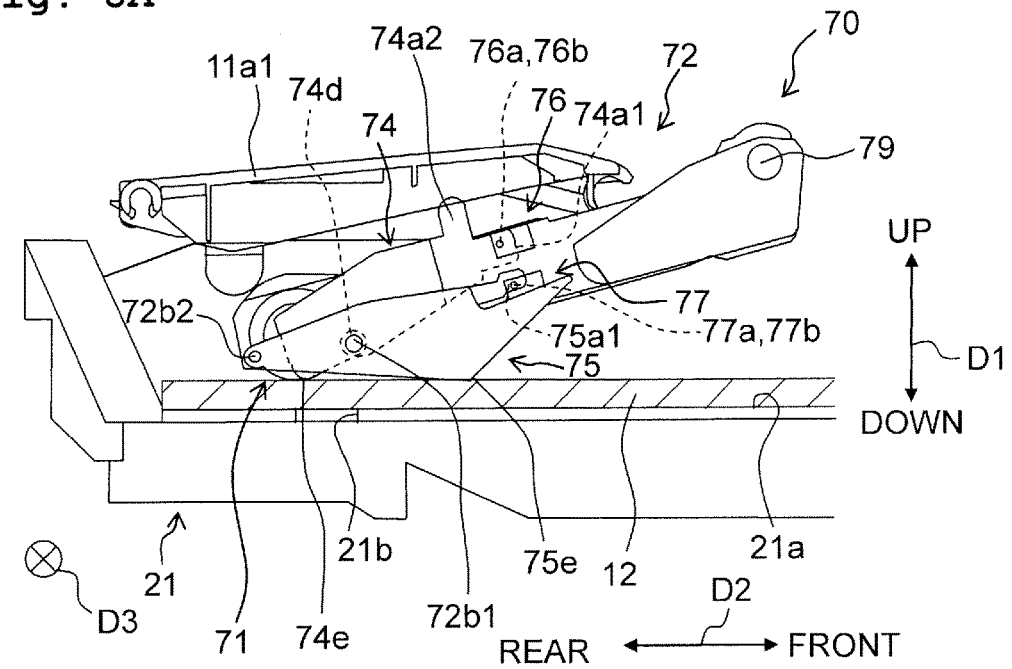
FIG. 8A is a schematic view showing the positional relationship between the two actuators and the two sensors when the paper load amount of the paper feed tray is decreased by one sheet of paper from the predetermined amount A3.
Figure 8B:
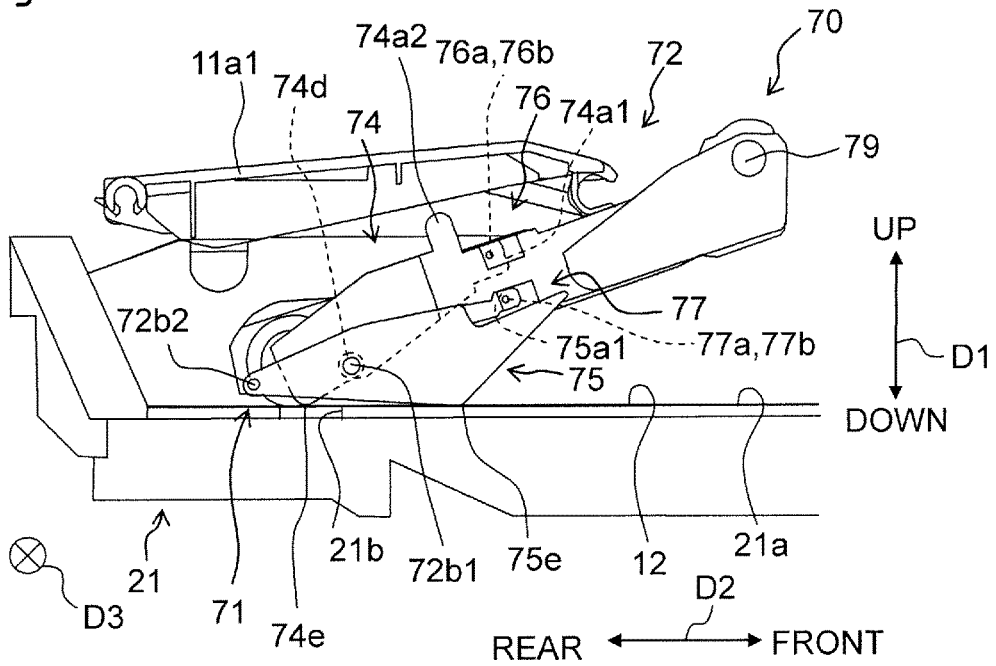
FIG. 8B is a schematic lateral view showing the positional relationship between the two actuators and the two sensors when the paper load amount of the paper feed tray is a predetermined amount A4.

Further, along with the recording and the like carried out on the paper 12, the paper 12 decreases and, as shown in FIGS. 8A and 8B, if the paper load amount of the paper feed tray 21 is less than the predetermined amount A3 but not less than the predetermined amount A4, then the actuator 74 stays continuously in the interference state, while the actuator 75 falls into the interference state from the noninterference state. On this occasion, the sensor 76 successively outputs the signal indicating the ON state to the controller 180, while the sensor 77 falls into the ON state and outputs the signal indicating the ON state to the controller 180. By virtue of this, based on the signals from the two sensors 76 and 77, the controller 180 determines it as the nearly empty state indicating that the residual paper 12 of the paper feed tray 21 has decreased significantly. Then, the controller 180 causes the display 150 to display that the load amount of the paper 12 is nearly empty.

Then, if the paper 12 of the paper feed tray 21 is used up, then as shown in FIG. 9, the actuator 74 falls into the noninterference state from the interference state, while the actuator 75 stays continuously in the interference state. On this occasion, the sensor 76 falls into the OFF state and outputs the signal indicating the OFF state to the controller 180, while the sensor 77 successively outputs the signal indicating the ON state to the controller 180. By virtue of this, based on the signals from the two sensors 76 and 77, the controller 180 determines it as the empty state indicating that there is no paper 12 of the paper feed tray 21. Then, the controller 180 causes the display 150 to display that the load of the paper 12 is empty. In this manner, based on the signals from the two sensors 76 and 77, it is possible for the controller 180 to determine the residual amount of paper of the paper feed tray 21 and cause the display 150 to display that residual state.

As described above, according to the paper feed device 20 of the present teaching, due to the swing of the arm 72 along with the change in the residual amount of the paper 12 loaded on the paper feed tray 21, the support shafts 72*b*1 and 72*b*2, which are the swing fulcrums for the actuators 74 and 75, move downward. On this occasion, the actuators 74 and 75 swing about the support shafts 72*b*1 and 72*b*2. Therefore, even if the actuators 74 and 75 in use are comparatively short and small in size, it is still possible to expand the range of load amount of the paper 12 on the paper feed tray 21 where it is possible for the actuators 74 and 75 to contact with the paper 12 by following the change in the residual amount of the paper 12. That is, it is possible for the actuator 74 to contact with the paper 12 by following the change in the residual amount of the paper 12 in the load amount range from the predetermined amount A2 to the predetermined amount A4. It is possible for the actuator 75 to contact with the paper 12 by following the change in the residual amount of the paper 12 in the load amount range from the predetermined amount A1 to the predetermined amount A4. Then, with the actuators 74 and 75, when the swing postures switch between the first postures B1 and C1 and the second postures B2 and C2, by adjusting the shapes of the actuators 74 and 75, the positions of the sensors 76 and 77, and the like, it is possible to appropriately select the residual amount of paper 12 from a wide load amount range. Hence, it is possible to satisfy both downsizing the paper feed device 20 by downsizing the actuators 74 and 75, and improving the usage convenience by expanding the detectable range of the residual amount of the paper 12.

As a reference example, speculations are made on a feeding apparatus whose actuator has a swing fulcrum fixed above the arm 72 (the frame 11*a*1 of the casing 11*a*, for example). In this case, the load amount range of the paper 12 of the paper feed tray 21, where the actuator is contactable with the paper 12, depends on the length of the actuator: the shorter the actuator, the narrower the range comparatively. Therefore, in order to expand this range, it is necessary to lengthen the actuator. In contrast to this, in the above embodiment, because the actuators 74 and 75 per se swing while their swing fulcrums are moving downward along with the swing of the arm 72 as described above, even though the actuator 74 and 75 are comparatively short, there is still maintained a wide load amount range of the paper 12 of the paper feed tray 21 where the actuators 74 and 75 are contactable with the paper 12.

As another reference example, speculations are made on a case of providing an actuator swinging about the swing fulcrum of the arm 72 along with the swing of that arm 72. In this case, from the point of view of shortening the arm, the swing fulcrum of the arm 72 is arranged a little above the uppermost sheet of the paper with the paper feed tray 21 loaded with the maximal load number of sheets of the paper 12, and the actuator is arranged at a height above the swing fulcrum of the arm 72. By virtue of this, the swing range for the part of the actuator to interfere with the sensor is provided in a position above the swing fulcrum. Hence, it is necessary to have a space above the swing fulcrum of the arm in order to secure the swing range for the actuator, thereby upsizing the paper feed device per se. However, the actuators according to the above embodiment are supported by the arm 72 to be swingable about the swing fulcrums provided between the swing fulcrum and the leading end of the arm 72, so that it is possible to downsize the paper feed device 20.

Further, in this embodiment, the two actuators 74 and 75 and the two sensors 76 and 77 are used to detect the residual amount of the paper 12 and, from the maximal load of sheets of the paper 12 to the empty load of sheets, the sensor 76 switches twice between the ON state and the OFF state, while the sensor 77 switches once between the ON state and the OFF state. Further, each of the sensors 76 and 77 differs from the other in the timing of switching the state. That is, at one load amount of the paper 12, only one of the two sensors 76 and 77 switches its state. Therefore, it is possible to determine the residual amount of the paper 12 in the paper feed tray 21 in three stages or four stages.

Especially, in this embodiment, during the load amount of the paper 12 of the paper feed tray 21 changing from the predetermined amount A1 to zero sheets, the sensor 76 switches its state twice, while the sensor 77 switches its state once. Then, the sensor 77 switches its state once when the load amount of the paper 12 is between the two load amounts corresponding to the two switches of its state of the sensor 76. Hence, it is possible to determine the residual amount detection of the paper 12 in four stages.

Further, it is possible to use a comparatively short and small actuator as each of the actuators 74 and 75, interfering with either one of the corresponding sensors 76 and 77.

Further, there is a load amount range of the paper 12 where the two actuators 74 and 75 are contactable with the same paper 12. In more detail, the actuators 74 and 75 contact with the same paper 12 in the range for the number of paper sheets to be not more than the first predetermined number of sheets (150 sheets in this embodiment) and not less than one sheet. Hence, there is no considerable difference in the positions of the two actuators 74 and 75 in the up-down direction D1. If there were no such load amount range of the paper 12 where the two actuators are contactable with the same paper 12, then the actuators would considerably differ in position in the up-down direction D1. In this embodiment, the two actuators 74 and 75 are arranged in almost the same position in terms of the up-down direction D1. Hence, it is possible to downsize the paper feed device 20 in the up-down direction D1 while realizing a multistage (four-state) detection of the residual amount.

The coil spring 74*d* biases the actuator 74 in the arrow F1 direction. Therefore, the swing operation of the actuator 74 is carried out reliably along with the decrease in the residual amount of the paper 12. Further, the actuator 75 is biased by its own weight in the arrow F2 direction. Due to this, too, the swing operation of the actuator 74 is carried out along with the decrease in the residual amount of the paper 12.

As a modification, the actuator 75 may be biased by a biasing member in the arrow F2 direction. Further, the biasing member may be made of an elastic member other than a coil spring. As another modification, the actuator 74 may not be biased by the coil spring 74*d* but be biased by its own weight in the arrow F1 direction. In this case, force f1 acting on the actuator 74 to rotate in the arrow F1 direction can be obtained by the following formula. Namely, $f1=N*\mu*\sin\varphi$, where N is vertical load of the actuator 74, $\mu$ is a coefficient of friction between the contact part 74*e* and the paper 12 depending on a type of the sheet 12, and $\varphi$ is a contact angle formed between the paper 12 and a virtual line connecting the contact part 74*e* and the support shaft 72*b*1. On the other hand, force f2 acting on the actuator 74 to rotate in a direction opposite to the arrow F1 direction can be obtained by the following formula. Namely, $f2=N*\tan\varphi*\sin\varphi$, where N is the vertical load of the actuator 74 and $\varphi$ is the contact angle formed between the paper 12 and the virtual line connecting the contact part 74*e* and the support shaft 72*b*1. Accordingly, it is necessary to determine the position of the support shaft 72*b*1 of the actuator 74 so that the force f2 is greater than the force f1.

Figure 12:
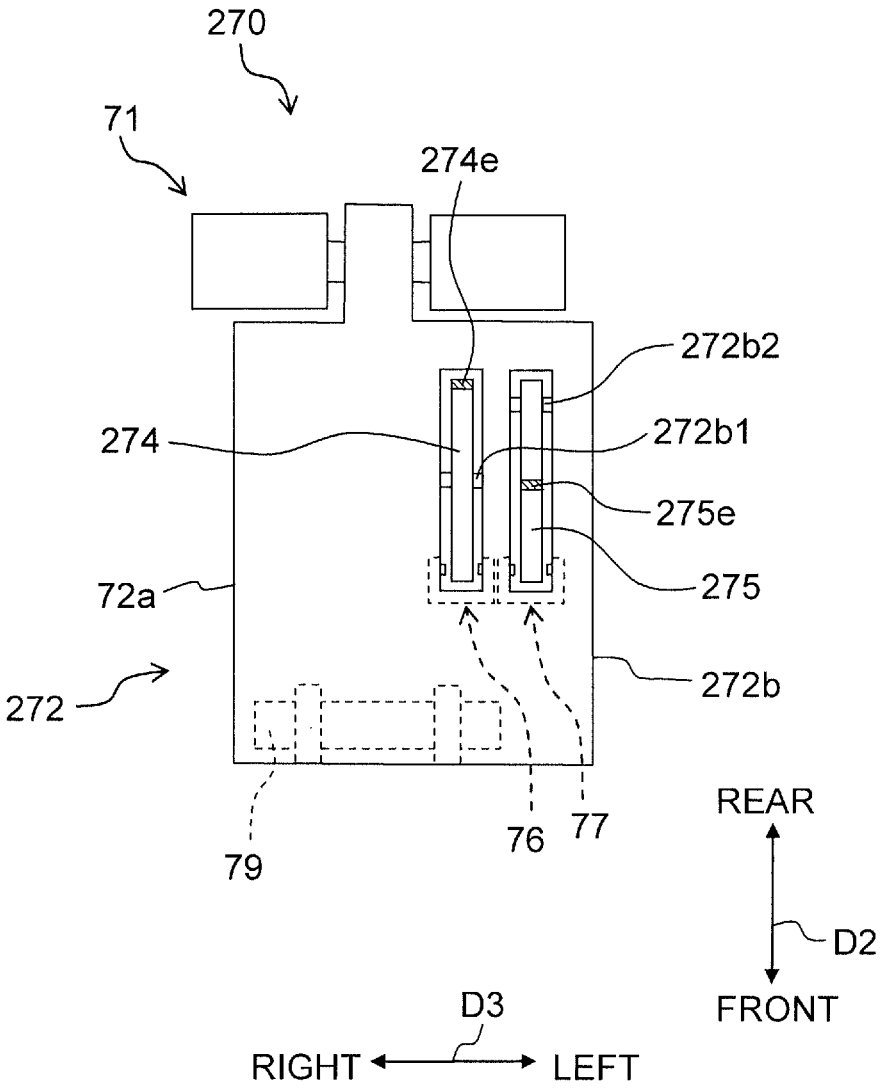
FIG. 12 is a plan view of a paper feed unit, as viewed from below, of a paper feed device according to a modification of the embodiment of the present teaching.

Further, as still another modification, a paper feed unit 270 may have, as shown in FIG. 12, an arm 272 in which actuators 274 and 275 have contact parts 274*e* and 275*e* positioned within the width of the paper feed roller 71 according to the left-right direction D3 (an axial direction). Components identical or equivalent to those in the embodiment described above are denoted with the same reference numerals or alpha-numerals, and any explanation therefor will be omitted.

As shown in FIG. 12, the actuators 274 and 275 are swingably supported by a support frame 272*b* via support shafts 272*b*1 and 272*b*2. The contact part 274*e* for the actuator 274 to contact with the paper 12 is arranged in the rear end. The contact part 275*e* for the actuator 275 to contact with the paper 12 is arranged at approximately the center according to the front-rear direction D2. In the same manner as in the above embodiment, the actuators 274 and 275 are configured to swing in mutually opposite directions along with the decrease in the residual amount of the paper 12. If the contact parts 274*e* and 275*e* are arranged within the width of the paper feed roller 71 in the left-right direction D3, then the rotation moment provided for the paper 12 will decrease due to the contact of the contact parts 274*e* and 275*e* with the paper 12. For example, if the contact parts of the actuators with the paper are not positioned within the width of the paper feed roller 71, then due to the contact with the actuators, a rotation moment will arise in the paper 12 fed by the paper feed roller 71. If this rotation moment is large, then the paper 12 will move obliquely to cause transport problems in feeding the paper 12. In this modification, however, because the contact parts 274*e* and 275*e* are positioned within the width of the paper feed roller 71, that rotation moment is restrained. Hence, the paper 12 is less likely to move obliquely.

Figure 13A:
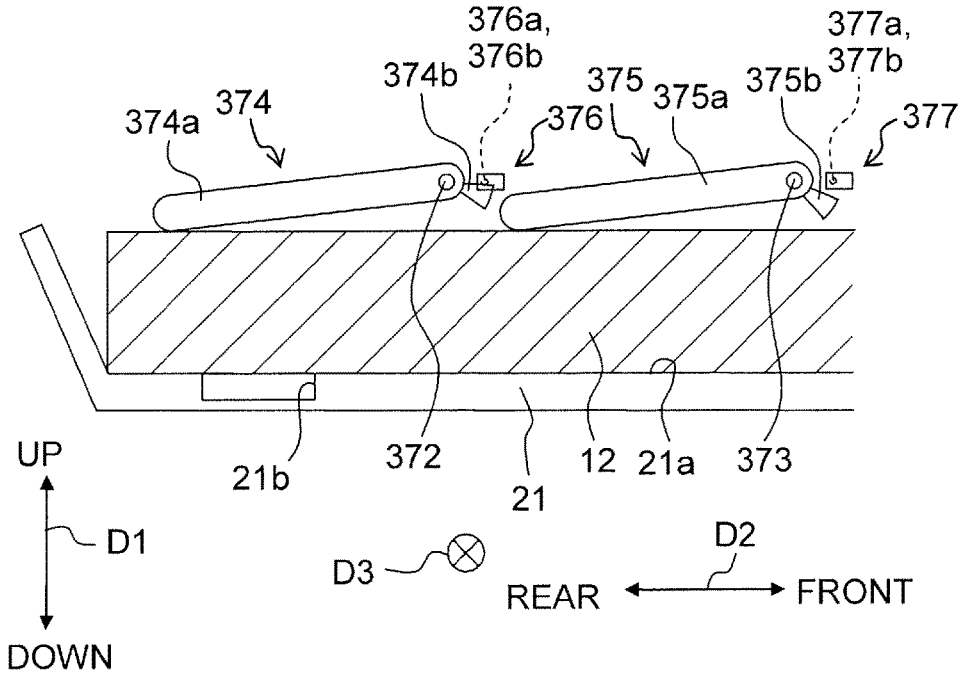

Further, as still another modification, as shown in FIG. 13A, on the casing 11*a*, there may be fixed two actuators 374 and 375 and two sensors 376 and 377 which constitute the paper feed unit. The two actuators 374 and 375 and the two sensors 376 and 377 are arranged to align in the front-rear direction. The actuator 374 has a body 374*a* and an interference portion 374*b*. The actuator 374 is supported by the casing 11*a* to be swingable about a support shaft 372 provided on the casing 11*a*. The actuator 374 is biased counterclockwise in FIG. 13A by its own weight, and its leading end contacts with the uppermost sheet of the paper 12 when the paper feed tray 21 has any of the paper 12. The support shaft 372 is arranged in a front end portion of the body 374*a*. The interference portion 374*b* is formed to project from the front base end of the body 374*a*.

The actuator 375 has almost the same configuration as the actuator 374, and has a body 375*a* and an interference portion 375*b*. The actuator 375 is supported by the casing 11*a* to be swingable about a support shaft 373 provided on the casing 11*a*. The actuator 375 is also biased counterclockwise in FIG. 13A by its own weight, and its leading end contacts with the uppermost sheet of the paper 12 when the paper feed tray 21 has any of the paper 12. The support shaft 373 is arranged in a front end portion of the body 375*a*. The interference portion 375*b* is formed to project from the front base end of the body 375*a*.

The two sensors 376 and 377 are optical sensors similar to the sensors 76 and 77 in the aforementioned embodiment, and have light-emitting elements 376*a* and 377*a* and light-receiving elements 376*b* and 377*b* respectively.

As shown in FIG. 13A, the interference portion 374*b* of the actuator 374 and the interference portion 375*b* of the actuator 375 are configured to come in a state of having retreated downward from the optical path of the sensor 376, that is, in a noninterference state, when the paper load amount of the paper feed tray 21 is the predetermined amount A2. Likewise, the interference portion 374*b* of the actuator 374 and the interference portion 375*b* of the actuator 375 are also configured to come in the state of having retreated downward from the optical path of the sensor 376 when the paper load amount of the paper feed tray 21 is more than the predetermined amount A2 but not more than the predetermined amount A1. In this manner, the actuators 374 and 375 are configured to respectively assume such swing postures (to be referred to below as "first postures B11 and C11) that the respective corresponding sensors 376 and 377 may come in the "OFF state" when the paper load amount of the paper feed tray 21 is not more than the predetermined amount A1 but not less than the predetermined amount A2.

Figure 13B:
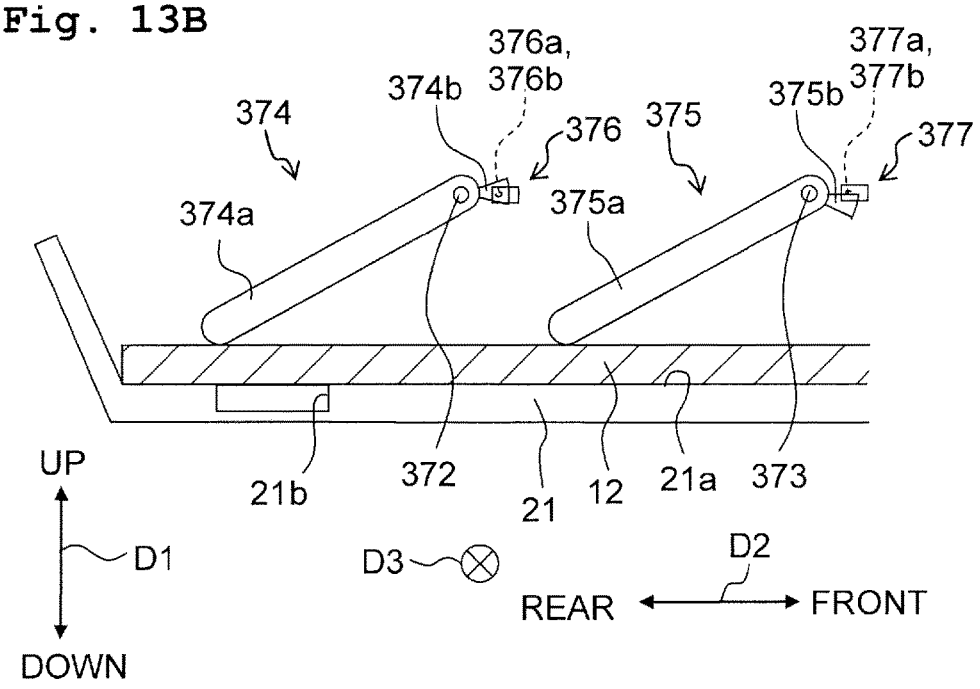

As shown in FIG. 13B, the interference portion 374*b* is configured to come in a state of having entered the optical path of the sensor 376 when the paper load amount of the paper feed tray 21 is the predetermined amount A3. On the other hand, the interference portion 375*b* is configured to stay as it is in the state of having retreated downward from the optical path of the sensor 377. When the paper load amount of the paper feed tray 21 is more than the predetermined amount A3 and less than the predetermined amount A2, it is also configured that the interference portion 374*b* comes in the state of having entered the optical path of the sensor 376 whereas the interference portion 375*b* comes in the state of having retreated from the optical path of the sensor 377. In this manner, the actuator 374 is configured to assume such a swing posture (to be referred to below as "second posture B12") that the sensor 376 may come in the "ON state" when the paper load amount of the paper feed tray 21 is less than the predetermined amount A2 but not less than the predetermined amount A3. On the other hand, the actuator 375 on this occasion assumes the first posture C11 as it is for the sensor 377 to be in the "OFF state", in the same manner as when the paper load amount of the paper feed tray 21 is not less than the predetermined amount A2.

Figure 14A:
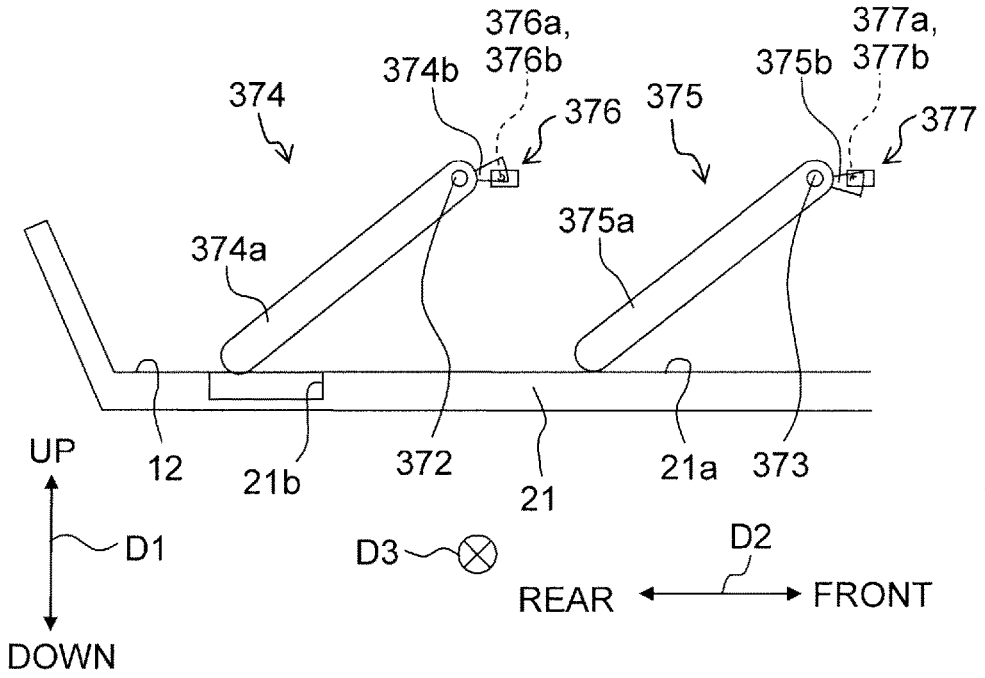

As shown in FIG. 14A, the interference portion 374*b* is configured to stay as it is in the state of having entered the optical path of the sensor 376 when the paper load amount of the paper feed tray 21 is the predetermined amount A4. On the other hand, the interference portion 375*b* is configured to come in a state of having entered the optical path of the sensor 377. It is also configured that the interference portion 374*b* comes into the state of having entered the optical path of the sensor 376 whereas the interference portion 375*b* comes into the state of having entered the optical path of the sensor 377, when the paper load amount of the paper feed tray 21 is more than the predetermined amount A4 but less than the predetermined amount A3. In this manner, when the paper load amount of the paper feed tray 21 is less than the predetermined amount A3 but not less than the predetermined amount A4, the actuator 374 assumes the second posture B12 as it is for the sensor 376 to be in the "ON state", in the same manner as when the paper load amount of the paper feed tray 21 is less than the predetermined amount A2 but not less than the predetermined amount A3. On the other hand, the actuator 375 is configured to assume such a swing posture (to be referred to below as "second posture C12") that the sensor 377 may be in the "ON state".

Figure 14B:
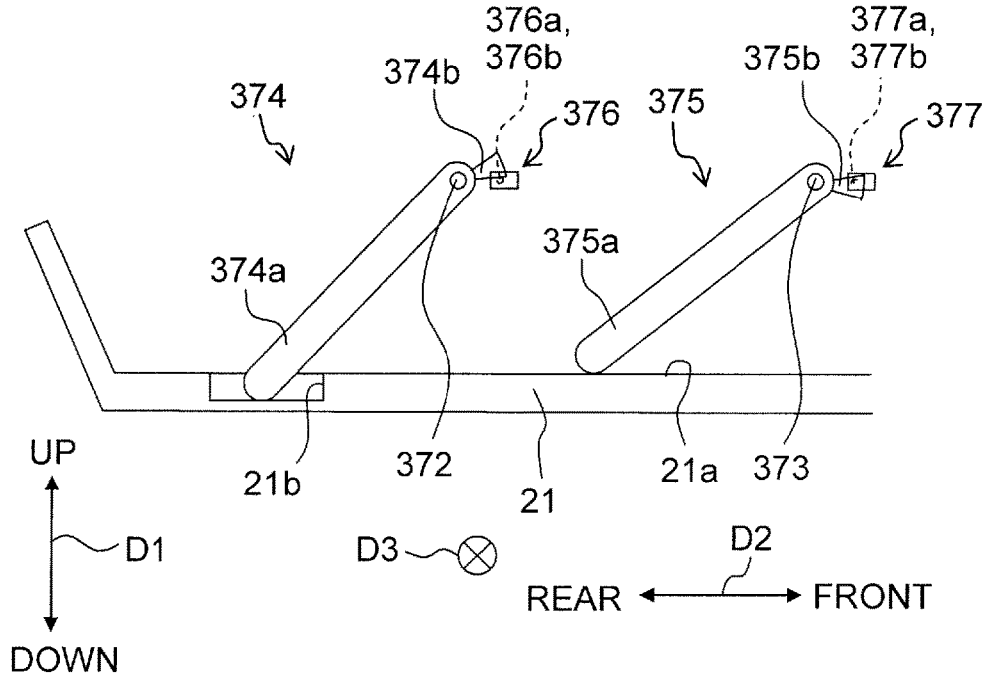

As shown in FIG. 14B, if the paper 12 of the paper feed tray 21 is used up, then the leading end of the body 374*a* falls into the hole 21*b*. In this state, the interference portion 374*b* is configured to come in a state of having retreated upward from the optical path of the sensor 376. On the other hand, the leading end of the body 375*a* is in contact with the bottom 21*a*. In this state, the interference portion 375*b* is configured to stay as it is in the state of having entered the optical path of the sensor 377. In this manner, the actuator 374 is configured to assume such a swing posture (to be referred to below as "third posture B13") that the sensor 376 may come in the "ON state". As described above, between the first posture B11 and the third posture B13, the interference portion 74*a*1 is in opposite positions with respect to the sensor 376. On the other hand, the actuator 375 on this occasion assumes the second posture C12 as it is for the sensor 377 to be in the "ON state", in the same manner as when the paper load amount of the paper feed tray 21 is less than the predetermined amount A3 but not less than the predetermined amount A4.

In this manner, in this modification, in the same manner as in the aforementioned embodiment, it is also possible to determine, in four stages, the residual amount of the paper 12 in the paper feed tray 21. Further, in this modification, each one of the sensors 376 and 377 is provided to correspond to one of the actuators 374 and 375. Therefore, it is possible to reduce the lengths of the interference portions 374*b* and 375*b* of the respective actuators 374 and 375. If two sensors are supposedly used for one actuator, then the interference portion is to be longer for being able to interfere with the two sensors, thereby lengthening the whole actuator. In this modification, however, it is possible to use the actuators 374 and 375 in a comparatively small size. Further, in the same manner as in the aforementioned embodiment, the two actuators 374 and 375 have a range of load amount of the paper 12 to be contactable with the same paper 12. Therefore, the two actuators 374 and 375 do not differ significantly in position along the up-down direction D1. In this modification, the two actuators 374 and 375 are in almost the same position according to the up-down direction D1. Hence, it is possible to reduce the size of the paper feed device 20 in the up-down direction D1 while realizing a multistage (four-stage) residual amount detection.

While the preferred embodiment of the present teaching is explained above, the present teaching is not limited to the above embodiment but is changeable in various manners as far as subject to the description of the appended claims. The present teaching as described above holds independent of the number of actuators included in the feeding apparatus. That is, the feeding apparatus of the present teaching may have only one actuator. Further, the feeding apparatus may have three actuators or more as well. In such cases, a number of sensors may be provided to correspond to the number of actuators.

Further, while the first predetermined amount for the actuator 74 in the above embodiment is less than the maximal paper load amount, the first predetermined amount for the actuator 74 may be equal to the maximal paper load amount. Further, while the second predetermined amount for the actuators 74 and 75 in the above embodiment is equivalent to one sheet of the paper, it may be more than that. Further, the second predetermined amount may be different from each other for the actuator 74 and the actuator 75.

Further, it may also be configured that during the paper load amount of the paper feed tray 21 changing from the predetermined amount A1 to zero sheets, the sensors 76 and 376 switch once between the ON state and the OFF state whereas the sensors 77 and 377 switch twice between the ON state and the OFF state. Further, the sensors 76, 77, 376, and 377 may all be configured to switch once or twice between the ON state and the OFF state.

Further, in the aforementioned embodiment, the sensor 76 switches twice between the "ON state" and the "OFF state" at the timings of the paper load amount of the paper feed tray 21 becoming less than the predetermined amounts A2 and A4, whereas the sensor 77 switches once between the "ON state" and the "OFF state" at the timing of the paper load amount of the paper feed tray 21 becoming less than the predetermined amount A3. That is, while each of the timing is different from another for the sensor 76 and the sensor 77 to switch in state, if at least one of the sensor 76 and the sensor 77 is configured to switch twice or more, then such a timing may exist that the sensor 76 and the sensor 77 switch in state at the same time.

Further, while transmission-type optical sensors are used as the sensors fixed on the arm in the above embodiment, it is possible to use other sensors than transmission-type optical sensors and to appropriately select the places for setting the sensors as long as the sensors output signals capable of distinguishing the swing postures of the actuators between the first posture and the second posture. For example, the sensors 76, 77, 376, and 377 may be mechanical sensors switching between the ON state and the OFF state by contact with the interference portions 74*a*1, 75*a*1, 374*b*, and 375*b* of the actuators 74, 75, 374, and 375. Further, the sensors may be turned into three states or more. As the sensors, for example variable resistors may be provided on the support shafts 72*b*1 and 72*b*2 and their resistance values may change with the swings of the actuators 74 and 75. In doing so, it becomes possible to detect the residual amount of paper in more stages. Further, it is also possible to obtain a similar effect by using encoder sensors. Further, two or more sensors may be arranged on the arm along the swing direction of the actuators to allow for a multistage detection of the residual amount of paper. Further, transmission-type optical sensors may be arranged in the actuators, while two or more slits are formed in the arm to align along the swing direction of the actuators. It is possible to apply modifications of such kinds of sensors regardless of the number of actuators in the feeding apparatus.

Further, with one actuator, during the media load amount of the loading portion changing from the first predetermined amount to the second predetermined amount, the swing posture may be switched twice or more between the first posture and the second posture. It is possible to realize such a configuration not only by adopting a system capable of, for example, the multistage detection of residual amount of paper described above, but also by letting the sheets of residual paper of the paper feed tray 21 be a suitable number not less than one sheet right after the sensor 76 related to the actuator 74 has changed from ON to OFF in the above embodiment. That is, in such cases, during the actuator 74 in contact with the paper, the sensor 76 switches its state twice. Then, in the above embodiment, the actuator 74 is provided with the contact portion 74*a*2 and, when the paper load amount of the paper feed tray 21 is not more than the predetermined amount A1 but not less than the predetermined amount A2, the contact portion 74*a*2 is to contact with the frame 11*a*1. Therefore, it is possible to reliably keep the sensor 76 in the "OFF state" at the predetermined amount A2 or more as described above. Further, when the paper load amount of the paper feed tray 21 is not more than the predetermined amount A1 but not less than the predetermined amount A2, even if such a configuration is adopted that part of the actuator 74 does not contact with the frame 11*a*1, it is still possible to turn the sensor 76 into the "OFF state" at the predetermined amount A2 or more, that is, to switch the state of the sensor 76 twice during the actuator 74 in contact with the paper. For example, it may be configured that the first actuator contacts with the paper 12 being from a predetermined amount G1 smaller than the maximal paper load amount of the paper feed tray 21, to the predetermined amount A4, whereas the second actuator contacts with the paper 12 being from a predetermined amount G2 smaller than the predetermined amount G1, to the predetermined amount A4. That is, both of the two actuators may be configured to contact with the frame for a large amount of the paper load, in the same manner as the aforementioned actuator 74.

Further, if it is possible for the contact parts 74*e*, 75*e*, 274*e* and 275*e* of the actuators 74, 75, 274 and 275 to contact with the paper 12, then those contact parts may be provided anywhere in the actuators 74, 75, 274, and 275. The sensors 76 and 77 may be fixed on the casing 11*a*. The actuators 74, 75, 274, and 275 may not overlap with one another in the front-rear direction D2. The actuators 374 and 375 may overlap with each other in the front-rear direction D2.

The present teaching is applicable not only to multifunction printers but also to paper feed devices of line/serial ink jet printers, laser/thermal recording devices, etc. The sheets may be other than those of the paper 12.

What is claimed is:

1. A feeding apparatus comprising:

a loading unit configured to load a plurality of sheet-like media in a stacked state;

a feeding roller configured to feed the media by rotating while abutting against the media loaded on the loading unit;

an arm swingably attached to a support shaft, the arm having a leading end adjacent the feeding roller and opposite the support shaft, the arm having a feeding roller shaft defining a feeding roller axis about which the feeding roller is rotatably supported, the arm including a fulcrum located between the support shaft and the leading end of the arm, the fulcrum defining a fulcrum axis different than the feeding roller axis;

at least one actuator supported by the arm to be swingable about the fulcrum, the at least one actuator comprising a contact portion at which the at least one actuator makes contact with the media on the loading unit; and at least one sensor configured to output a signal which differentiates a first posture of the at least one actuator with respect to the arm, from a second posture different from the first posture, wherein while a load amount of the media on the loading unit is decreased from a first predetermined amount to a second predetermined amount less than the first predetermined amount, the at least one actuator is configured to be in contact with the media loaded on the loading unit and to swing about the fulcrum as the load amount of the media is decreased; and while the load amount of the media on the loading unit is decreased from the first predetermined amount to the second predetermined amount, the at least one actuator is configured to be switched at least once between the first posture and the second posture.

2. The feeding apparatus according to claim 1, wherein the contact portion is positioned farther from the support shaft than the fulcrum.

3. The feeding apparatus according to claim 1, wherein the fulcrum is positioned farther from the support shaft than the contact portion.

4. The feeding apparatus according to claim 1, wherein a linear distance between the fulcrum and the leading end of the arm is longer than a linear distance between the fulcrum and one end of the at least one actuator farthest from the support shaft; and a linear distance between the fulcrum and the support shaft is longer than a linear distance between the fulcrum and the other end of the at least one actuator closest to the support shaft.

5. The feeding apparatus according to claim 1, wherein the at least one sensor is configured to output signals different from each other in an interference state interfering with the at least one actuator and in a noninterference state not interfering with the at least one actuator; and the at least one sensor is configured to be in one of the interference state and the noninterference state under a condition that the at least one actuator is in the first posture, and to be in the other of the interference state and the noninterference state under a condition that the at least one actuator is in the second posture.

6. The feeding apparatus according to claim 1, wherein the at least one sensor is supported by the arm.

7. The feeding apparatus according to claim 1, wherein the contact portion is positioned inside both ends of the feeding roller with respect to a rotation axis direction of rotation of the feeding roller.

8. The feeding apparatus according to claim 1, wherein the at least one actuator is configured to be switched between the first posture and the second posture under a condition that the load amount of the media on the loading unit is changed from one sheet to zero sheets.

9. The feeding apparatus according to claim 1, further comprising a biasing member configured to bias the at least one actuator in a swing orientation in which the at least one actuator swings as the load amount of the media on the loading unit is decreased.

10. The feeding apparatus according to claim 1, wherein the at least one actuator is configured to swing due to its own weight as the load amount of the media on the loading unit is decreased.

11. A feeding apparatus comprising:

a loading unit configured to load a plurality of sheet-like media in a stacked state;

a feeding roller configured to feed the media by rotating while abutting against the media loaded on the loading unit;

an arm swingably attached to a support shaft, the arm having a leading end adjacent the feeding roller and opposite the support shaft, the arm having a feeding roller shaft defining a feeding roller axis about which the feeding roller is rotatably supported, the arm including a fulcrum located between the support shaft and the leading end of the arm, the fulcrum defining a fulcrum axis different than the feeding roller axis;

at least one actuator supported by the arm to be swingable about the fulcrum, the at least one actuator comprising a contact portion at which the at least one actuator makes contact with the media on the loading unit; and at least one sensor configured to output a signal which differentiates a first posture of the at least one actuator with respect to the arm, from a second posture different from the first posture, wherein the at least one actuator includes a first actuator swingable about a first fulcrum, and a second actuator swingable about a second fulcrum, the at least one sensor includes a first sensor outputting signals different from each other in a first interference state interfering with the first actuator and in a first noninterference state not interfering with the first actuator, and a second sensor outputting signals different from each other in a second interference state interfering with the second actuator and in a second noninterference state not interfering with the second actuator, while a load amount of the media on the loading unit is decreased from a first predetermined amount to a second predetermined amount less than the first predetermined amount, the first actuator is configured to be in contact with the media loaded on the loading unit, and to swing about the first fulcrum as the load amount of the media is decreased, while the load amount of the media on the loading unit is decreased from a third predetermined amount to a fourth predetermined amount less than the third predetermined amount, the second actuator is configured to be in contact with the media loaded on the loading unit, and to swing about the second fulcrum as the load amount of the media is decreased, while the load amount of the media on the loading unit is changed from the first predetermined amount to the second predetermined amount, the first sensor is configured to be switched once or twice between the first interference state and the first noninterference state, while the load amount of the media on the loading unit is changed from the third predetermined amount to the fourth predetermined amount, the second sensor is configured to be switched once or twice between the second interference state and the second noninterference state, only one of the first sensor and the second sensor is switched at least one load amount, and a range of the load amount between the first predetermined amount and the second predetermined amount overlaps with a range of the load amount between the third predetermined amount and the fourth predetermined amount at least partially.

12. The feeding apparatus according to claim 11, wherein while the load amount of the media on the loading unit is decreased from the first predetermined amount to the second predetermined amount, the first sensor is configured to be switched twice between the first interference state and the first noninterference state, and under a condition that the load amount of the media on the loading unit is more than the second predetermined amount and less than the first predetermined amount, the second sensor is configured to be switched once between the second interference state and the second noninterference state.

13. The feeding apparatus according to claim 11, wherein a straight line which passes through the first sensor and the first fulcrum intersects with a plane which is parallel to a top surface of the media loaded on the loading unit and passes through the first fulcrum at a first angle, and a straight line which passes through the second sensor and the second fulcrum intersects with a plane which is parallel to a top surface of the media loaded on the loading unit and passes through the second fulcrum at a second angle different from the first angle.

14. The feeding apparatus according to claim 11, wherein the first fulcrum and the second fulcrum differ in position from each other with respect to a direction orthogonal to a top surface of the media loaded on the loading unit.

15. The feeding apparatus according to claim 11, wherein the first actuator overlaps with the second actuator at least partially in a feeding direction in which the feeding roller feeds the media on the loading unit.

16. The feeding apparatus according to claim 15, wherein the first actuator and the second actuator are in the same position with respect to the feeding direction.

17. The feeding apparatus according to claim 15, wherein the first sensor and the second sensor are in the same position with respect to the feeding direction.

18. The feeding apparatus according to claim 11, wherein an interference part of the first actuator with the first sensor is positioned on a side opposite to a contact part of the first actuator with the media with respect to the first fulcrum, and an interference part of the second actuator with the second sensor is positioned on a side opposite to the second fulcrum with respect to a contact part of the second actuator with the media.

19. The feeding apparatus according to claim 11, wherein each of the first fulcrum and the second fulcrum is provided between the leading end of the arm and the support shaft.

20. The feeding apparatus according to claim 19, wherein the first and second sensors are supported by the arm.

21. A feeding apparatus comprising:

a loading unit configured to load a plurality of sheet-like media in a stacked state;

a feeding roller configured to feed the media by rotating while abutting against the media loaded on the loading unit;

an arm swingably attached to a support shaft, the arm having a leading end adjacent the feeding roller and opposite the support shaft, the arm having a feeding roller shaft defining a feeding roller axis about which the feeding roller is rotatably supported, the arm including a fulcrum located between the support shaft and the leading end of the arm, the fulcrum defining a fulcrum axis different than the feeding roller axis;

an actuator supported by the arm to be swingable about the fulcrum;

a sensor configured to output signals different from each other in an interference state interfering with the actuator and in a noninterference state not interfering with the actuator; and a contact member configured to be in contact with the actuator, wherein while a load amount of the media on the loading unit is decreased from a first predetermined amount to a second predetermined amount less than the first predetermined amount, the actuator is configured to swing about the fulcrum while being in contact with the media loaded on the loading unit, and to be switched at least once between a first posture and a second posture different from the first posture, under a condition that the load amount of the media on the loading unit is not less than the first predetermined amount, the actuator is configured to be in contact with the contact member and to be kept in the first posture, under a condition that the load amount of the media on the loading unit is less than the first predetermined amount, the actuator is configured to be apart from the contact member and switched to the second posture, and the sensor is configured to be in one of the interference state and the noninterference state under a condition that the actuator is in the first posture, and to be in the other of the interference state and the noninterference state under a condition that the actuator is in the second posture.

* * * * *